US010100574B2

(12) United States Patent
Reiner et al.

(10) Patent No.: US 10,100,574 B2
(45) **Date of Patent: *Oct. 16, 2018**

(54) RETRACTABLE BARRIER SYSTEM

(71) Applicant: GlideRite Corporation, Van Nuys, CA (US)

(72) Inventors: Andrew Eric Reiner, Woodland Hills, CA (US); Thomas Rose, Woodland Hills, CA (US)

(73) Assignee: Glide Rite Corporation, Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/201,665

(22) Filed: Jul. 5, 2016

(65) Prior Publication Data

US 2017/0284154 A1 Oct. 5, 2017

Related U.S. Application Data

(63) Continuation-in-part of application No. 15/083,757, filed on Mar. 29, 2016.

(51) Int. Cl.
*A47G 5/00* (2006.01)
*E06B 9/18* (2006.01)
(Continued)

(52) U.S. Cl.
CPC ..... *E06B 9/18* (2013.01); *E06B 3/4636* (2013.01); *E06B 5/00* (2013.01); *E06B 9/60* (2013.01); *E06B 9/78* (2013.01); *E06B 2009/002* (2013.01)

(58) Field of Classification Search
CPC ..... E06B 9/18; E06B 9/60; E06B 9/78; E06B 2009/002; E06B 11/02; E06B 11/023; E06B 11/026; A47H 1/13
(Continued)

(56) References Cited

U.S. PATENT DOCUMENTS 746,403 A * 12/1903 Tarney ..... E06B 9/54 160/23.1
832,335 A * 10/1906 McDonald ..... E06B 9/13 160/264
(Continued)

FOREIGN PATENT DOCUMENTS

WO WO9713049 A1 4/1997

*Primary Examiner* — Katherine W Mitchell
*Assistant Examiner* — Johnnie A. Shablack

(57) ABSTRACT

A retractable barrier system for inhibiting access to designated private and public areas both indoors and outdoors, including by way of example but not limitation, retail and warehouse aisles and the like, includes a flexible screen retractable and extensible from a rotatable rod coupled to a mounting member, the mounting member having an attachment mechanism for coupling with a receiving member, wherein a winding mechanism is coupled to the rotatable rod for retractably receiving and extending the flexible screen, the flexible screen is comprised of material having a sufficient modulus of elasticity to promote substantially smooth retractably receiving thereof and may further include tapering between ends thereof, and the winding mechanism may include a guide member having a surface of sufficient diameter oriented substantially perpendicular to the flexible screen to guide the flexible screen upon retractably receiving the screen.

21 Claims, 21 Drawing Sheets

(51) Int. Cl.

| | |
|---|---|
| ***E06B 9/60*** | (2006.01) |
| ***E06B 9/78*** | (2006.01) |
| ***E06B 5/00*** | (2006.01) |
| ***E06B 3/46*** | (2006.01) |
| *E06B 9/00* | (2006.01) |

(58) Field of Classification Search
USPC ..... 160/29.1, 23.1, 313, 24, 31
See application file for complete search history.

(56) References Cited

U.S. PATENT DOCUMENTS 1,692,206 A * 11/1928 Griffiths ..... E06B 9/54 160/273.1
2,583,824 A * 1/1952 Dwinell ..... E04F 10/0618 160/121.1
2,859,944 A * 11/1958 Cisney ..... E06B 11/021 160/328
4,016,921 A * 4/1977 Ericksen ..... E06B 11/021 160/328
4,844,420 A * 7/1989 Oster ..... B65H 75/38 160/24
5,170,829 A 12/1992 Duncan et al.
5,275,220 A * 1/1994 Siegal ..... E04B 2/7416 160/24
5,636,679 A 6/1997 Miller et al.
5,690,317 A * 11/1997 Sandsborg ..... E06B 9/08 160/300
5,704,592 A * 1/1998 White ..... E01F 13/022 160/135
6,056,038 A 5/2000 Foster et al.
6,360,984 B1 * 3/2002 England ..... B65H 16/02 242/557
6,375,165 B1 * 4/2002 Sherratt ..... E06B 9/0692 256/1
6,435,250 B1 8/2002 Pichik et al.
6,499,254 B2 * 12/2002 Rossman ..... A01K 1/0017 160/210
6,536,502 B2 * 3/2003 Britto ..... E06B 9/08 160/23.1
6,575,435 B1 6/2003 Katzen
6,591,890 B1 * 7/2003 Grubb ..... E06B 9/80 160/291
6,655,736 B1 * 12/2003 Arenas ..... B60N 2/6063 160/24
6,688,480 B1 2/2004 Denny
6,733,204 B1 * 5/2004 Paniccia ..... E01F 7/06 160/238
6,779,537 B1 * 8/2004 Miller ..... A01M 31/00 135/117
6,807,999 B1 10/2004 Bowen et al.
6,814,127 B2 * 11/2004 Tagtow ..... E06B 9/54 160/273.1
6,854,505 B2 * 2/2005 Grubb ..... E06B 9/80 160/291
6,991,693 B2 * 1/2006 Wylie ..... E06B 9/52 156/160
7,082,981 B2 * 8/2006 Perez, Jr. ..... A01K 1/035 160/24
7,178,792 B2 * 2/2007 Monahan ..... E06B 9/08 160/10
7,207,370 B2 4/2007 Snyder et al.
7,219,709 B1 5/2007 Williams
7,237,591 B2 7/2007 Snyder et al.
7,337,822 B2 3/2008 Snyder et al.
7,370,685 B2 * 5/2008 Moriya ..... E06B 9/54 160/120
7,377,490 B1 * 5/2008 Khosravian ..... E01F 13/028 119/416
7,384,017 B1 6/2008 Burke et al.
7,438,112 B2 * 10/2008 Cheng ..... E01F 13/028 160/24
7,472,739 B2 * 1/2009 Heidenreich ..... E04F 10/0648 160/122
7,487,816 B2 * 2/2009 Moriya ..... E06B 9/54 160/23.1
7,503,374 B2 * 3/2009 Takeuchi ..... B60J 1/2027 160/370.21
7,581,775 B2 * 9/2009 Lekar ..... B60J 1/2072 160/314
8,087,443 B2 1/2012 Snyder et al.
8,191,604 B2 * 6/2012 Wang ..... E06B 9/0692 160/23.1
8,327,565 B2 * 12/2012 Boltz ..... G09F 15/0025 256/24
8,490,668 B2 7/2013 Snyder et al.
8,528,623 B2 * 9/2013 Roberts ..... E06B 9/54 160/267.1
8,584,401 B2 * 11/2013 Planck ..... E06B 11/02 404/6
8,826,963 B2 * 9/2014 Wiegel ..... B65G 69/003 160/23.1
8,863,811 B2 * 10/2014 Yates ..... E06B 9/0623 160/136
8,881,787 B2 * 11/2014 Wang ..... E06B 9/60 160/24
8,887,441 B2 * 11/2014 Lundh ..... E05B 43/00 160/296
8,925,614 B2 * 1/2015 Okachi ..... E06B 9/54 160/31
8,991,470 B1 3/2015 Pacheco
9,598,896 B1 * 3/2017 Pichik ..... E06B 9/08
2005/0098770 A1 5/2005 Schell
2005/0211389 A1 * 9/2005 Snyder ..... E01F 13/028 160/23.1
2006/0076544 A1 4/2006 Kurple
2006/0113519 A1 6/2006 Prismall
2006/0151123 A1 7/2006 Chandler et al.
2006/0191644 A1 * 8/2006 Snyder ..... E01F 13/028 160/23.1
2006/0213626 A1 * 9/2006 Snyder ..... E01F 13/028 160/120
2007/0228349 A1 * 10/2007 Smith ..... E01F 13/028 256/12.5
2008/0006375 A1 * 1/2008 Meadows ..... E06B 9/52 160/371
2008/0121354 A1 * 5/2008 Cheng ..... E06B 9/80 160/290.1
2009/0008042 A1 * 1/2009 Snyder ..... E01F 13/028 160/264
2013/0213589 A1 * 8/2013 Hicks ..... E06B 9/54 160/268.1
2014/0041814 A1 * 2/2014 Roberts ..... A47H 5/03 160/271
2014/0060757 A1 * 3/2014 Thompson ..... E04F 10/06 160/238
2014/0196371 A1 * 7/2014 Lundh ..... E05B 17/10 49/13
2015/0190001 A1 7/2015 Floersch et al.
2016/0245381 A1 * 8/2016 Birkert ..... F16H 25/20

* cited by examiner

RETRACTABLE BARRIER SYSTEM

CROSS-REFERENCE TO RELATED APPLICATIONS

This application is a continuation-in-part of application Ser. No. 15/083,757 filed Mar. 29, 2016, the specification of which is incorporated herein by reference in its entirety.

TECHNICAL FIELD

This invention relates generally to removable gates for temporarily inhibiting access to designated areas, and more particularly to an improved portable and retractable barrier system that may be readily extended and retracted to temporarily prevent access to designated areas, including, but not limited to, retail and warehouse aisles, checkout aisles, and other private and public spaces both indoors and outdoors.

BACKGROUND ART

Removable gates, particularly child and pet safety gates, are well known in the art for use in preventing access to residential areas considered unsafe or undesirable for children or pets. Conventional gates characteristically comprise a plurality of cooperating gate sections that are generally horizontally extensible and retractable within narrow entryways such as between doorjambs, opposed walls, and balustrade uprights, and the like. These safety gates are commonly provided on ends thereof with compressible buffer stops comprising elastomeric material or other suitable spring mechanisms, which when compressed and then released, function to effectively set the corresponding gate or gate sections against displacement between the respective opposed fixed extremes defined by the entryways. Additional safety latches and the like have been used to further secure the relative positions of the corresponding gate sections and prevent inadvertent or undesired disengagement of the same following installation.

To remove the aforementioned safety gates after installation, the safety latches, if any, must first be disabled or released whereupon the buffer stops may be compressed (generally by applying lateral pressure to the same) to temporarily relieve applied tension on the opposed fixed extremes of the corresponding entryways. The gate sections may then be sufficiently retracted for the gate or gate system to be removed. Removable child and pet safety gates of the type described above are commonly used in residential environments to prevent access to kitchens, stairways, garages, and other living and working areas.

Removable gates have similarly been used, for example, in retail and warehouse environments to temporarily prevent access to designated service and work areas including shopping aisles, check-out aisles and the like, as may be defined, for example, by shelving and storage racks such as pallet rack systems and assemblies. As those skilled in the art will recognize, conventional pallet rack systems typically comprise a plurality of support posts for receiving corresponding horizontal connecting lengths and vertically spaced horizontal rack beams. Each support post generally comprises a single piece of metal having an outwardly faced or facing post section or margin, parallel side post sections or margins, and an opposed terminal end section or margin defining a substantially square or rectangular post cross section. The outwardly facing post sections and parallel post sections are each typically provided with multiple rows of vertically spaced pairs of keyhole slots or other suitable stamped apertures. The slots in each pair are often angularly related to one another to allow a better fit for components being attached to the pallet rack, including the above referenced rack beams.

In the exemplary pallet rack systems described above, the support posts are secured together in any suitable relation by the referenced horizontal connecting lengths as well as a series of corresponding truss legs or the like. Characteristically, the connecting lengths are affixed to opposing terminal post end sections and/or parallel side post sections by threading and securing one or more fasteners through corresponding apertures such as the referenced keyhole slots. A plurality of vertically spaced horizontal rack beams are affixed to opposing parallel side post sections (and often the corresponding outwardly faced post sections as well) by similarly threading and securing one or more fasteners through the corresponding post section apertures. Each horizontal rack beam is typically comprised of sheet metal having a ledge for receiving and supporting a wooden plank or other suitable shelving material such as sheet metal decking or the like, which in turn receives and supports product for storage and display.

In the exemplary retail and warehouse applications above, the entryways and "aisles" defined by opposing post end sections of corresponding storage racks are typically substantially wider than residential entryways, and thus generally unsuitable for residential type compression gates. Accordion or "scissor-style" gates have therefore been employed which are capable of spanning these extended distances.

As those skilled in the art will recognize, accordion gates typically comprise a plurality of interconnected and moveable accordion elements or members that cooperate together to permit the respective gates to be unitarily extensible and retractable, as limited by the number and length of the corresponding elements. Accordion gates are typically mounted and substantially permanently affixed in the aforementioned entryways at their trailing gate ends to receiving outwardly facing post sections by threading one or more bolts through corresponding receiving keyholes or apertures stamped in the respective components. When not required for use, the gates are secured to the receiving posts in substantially retracted storage positions, limited by the number and width of extensible accordion elements, using chains, flexible cord, or other suitable retention devices. When it is subsequently desirable to block and inhibit access to a corresponding entryway and/or aisle section, the retention device is removed or disabled, whereupon the gate may be extended and secured at its leading end to a corresponding opposing and receiving outwardly facing post section in the same or similar manner using one or more bolts threaded through receiving keyholes or apertures.

The aforementioned accordion gates, while effective and commonly used to block access to designated areas, including the above exemplary retail and warehouse applications, by design comprise multiple movable accordion elements that increase the size, weight, and complexity of the corresponding gates, which in turn, correspondingly increases the associated costs of manufacture, shipping, maintenance and repair of the same. Those skilled in the art will further recognize that the above referenced exemplary installation common to such accordion gates, namely securing the same at trailing edges in retracted storage positions with chains and flexible cord, may result in decreased visibility of products or signage stored or displayed in proximity to the gate, particularly at or near end caps or shelving units. Still further, such accordion gates may extend or otherwise protrude, even in retracted, stored and secured positions, undesirable distances into corresponding entryways or aisles creating potential obstructions for shopping carts and machinery that may result in damage to the respective gates. Lastly, such gates, by design, are generally unsuitable for pre-printed signage, such as may be useful for example, to notify persons of the presence of the gate (whether in the extended or storage position) or advise that the corresponding aisle or area has been temporarily closed. Accordingly, retail and warehouse managers may be required to incur additional time and expense to obtain, post, and change such signage on or in proximity to such gates.

To address the above issues, there have been disclosed a variety of extensible, collapsible and retractable gates provided for use in temporarily blocking access to designated areas, including the above referenced retail and warehouse environments as well as residential applications. See, for example, Canadian Patent No. CA2233760 issued to Secure-Plast, Inc.; U.S. Pat. No. 5,170,829 issued to Duncan et al.; U.S. Pat. No. 5,636,679 issued to Miller et al.; U.S. Pat. No. 6,056,038 issued to Foster et al.; U.S. Pat. No. 6,435,250 issued to Pichik et al.; U.S. Pat. No. 6,575,435 issued to Tracy A. Kotzen; U.S. Pat. No. 6,688,480 issued to David S. Denny; U.S. Pat. No. 6,807,999 issued to Bowen et al.; U.S. Pat. No. 7,207,370 issued to Snyder et al.; U.S. Pat. No. 7,219,709 issued to John Williams; U.S. Pat. No. 7,237,591 issued to Snyder et al.; U.S. Pat. No. 7,337,822 issued to Snyder et al.; U.S. Pat. No. 7,384,017 issued to Burke et al.; U.S. Pat. No. 8,087,443 issued to Snyder et al.; U.S. Pat. No. 8,490,668 issued to Snyder et al.; U.S. Pat. No. 8,991,470 issued to Steven A. Pacheco; U.S. Patent Publication No. 2015190001 filed by Floersch et al.; U.S. Patent Publication No. 20050098770 filed by Ronald Allan Schell; U.S. Patent Publication No. 20050211389 filed by Snyder et al et al.; U.S. Patent Publication No. 20060076544 filed by William M. Kurple; U.S. Patent Publication No. 20060113519 filed by Ian James Prismall; U.S. Patent Publication No. 20060151123 filed by Chandler et al.; U.S. Patent Publication No. 20060191644 filed by Snyder et al.; U.S. Patent Publication No. 20060213626 filed by Snyder et al.; U.S. Patent Publication No. 20090008042 filed by Snyder et al.; and International Patent Application WO9713049 filed by Edwin Hardy.

The aforementioned extensible gates and gate systems address some of the issues raised above. However, they still generally require fixed storage positions and may therefore extend or protrude into corresponding entryways and aisles during such storage thus creating potential obstructions to shopping carts and machinery and reducing customer or employee visibility of displayed product and signage. Many such gate systems also require self-standing implementations wherein internal support posts are provided as part of the gate system thus raising concerns that the system may be removed or otherwise become inadvertently uninstalled. Still further, such gates, particularly extensible gates comprising tacky or "rubbery" materials or textures may become bound or "bunched up" during retraction creating difficulties to operate and/or uninstall.

Still further, as those skilled in the art will appreciate, in the exemplary pallet rack systems and assemblies of the type described above, shelving units, and more particularly, horizontal rack beams and corresponding fasteners, affixed to opposing outwardly facing post sections, may occupy all or part of an aperture row pair designated for affixing the respective trailing and leading gate ends. In such case, the gate ends will be required to be affixed to different aperture rows (above or below the occupied rows) possibly requiring gate placement at different heights at the respective leading and trailing gate ends and resulting in misalignment of the gate once extended. Still further, horizontal rack beams and the corresponding connecting bolts disposed in intervening aperture rows (within the span of respective top and bottom gate ends) as well as product stored on the received shelves, often extend or protrude from the receiving posts beyond the outwardly facing post sections into the defined entryways and aisles to obstruct and sometimes preclude attachment of the respective gate ends entirely. In such case, the referenced extensible gates and gate systems may not be used.

Accordingly, there is a need for an improved barrier system that overcomes the disadvantages of the prior art. Such a system should be aesthetically pleasing and capable of implementation in a variety of applications including, but not limited to, the above referenced retail and warehouse environments and the like, as well as private and public shopping, storage, service, and checkout areas and aisles, whether indoors or outdoors.

DISCLOSURE OF INVENTION

It is a principle object of the present invention to provide a portable and removable barrier system for use in inhibiting access to designated areas both indoors and outdoors, which system may be quickly and easily installed and removed and engaged and disengaged.

It is a further object of the present invention to provide a portable and removable barrier system for use in inhibiting access to such designated areas, which system is aesthetically pleasing and comprises a flexible screen that may be readily extended and retracted.

It is still further an object of the present invention to provide a portable and removable barrier system for use in inhibiting access to such designated areas, comprising a winding mechanism coupled to a rotatable rod for applying rotational tension on the rod, which winding mechanism comprises a spring mechanism including but not limited to a torsion spring, and a guide member having a surface of sufficient diameter oriented substantially perpendicular to a flexible screen to guide and inhibit binding of the screen upon retractably receiving the same.

It is still further an object of the present invention to provide such a portable and removable barrier system for use in inhibiting access to such designated areas, wherein the flexible screen is comprised of material or materials having a modulus of elasticity sufficiently high such that the screen has sufficient stiffness to inhibit binding or "bunching up" of the screen during retraction.

Yet still further, it is an object of the present invention to provide such a portable and removable barrier system for use in inhibiting access to such designated areas, wherein the flexible screen comprises one or more support members such as plastic, metal, wire, material, or the like, which support members may be coupled thereto to provide sufficient stiffness thus promoting the smooth retraction thereof by inhibiting or obviating binding or bunching up of the gate which might otherwise result during retraction.

In carrying out these and other objects, features and advantages of the present invention, there is provided a retractable barrier system for blocking and inhibiting access to a variety of designated areas including, but not limited to, private and public retail and warehouse aisles and the like, both indoors and outdoors. The barrier system generally comprises a rotatable rod, a flexible and retractable screen, and a winding mechanism. The rotatable rod may be coupled by an attachment mechanism to any suitable receiving bracket or aperture. The flexible screen includes a trailing edge that may be affixed to the rotatable rod, and a leading edge having an attachment mechanism for similarly coupling the screen with a corresponding leading edge receiving member. The winding mechanism, preferably, but not necessarily, comprises a spring mechanism coupled at one end to a fixed shaft and coupled at an opposing end to the rotatable rod. The winding mechanism functions to apply rotational tension against the rod for retractably receiving and extending the flexible screen between a closed position wherein the flexible screen is fully retracted and an open position wherein the screen is sufficiently extended to span and block an entryway, aisle, or other designated area.

In a preferred embodiment, the flexible screen is comprised of material or materials having a modulus of elasticity sufficiently high to inhibit binding or "bunching up" of the flexible screen thereby promoting the smooth retraction of the same. Alternatively, or in addition thereto, the flexible screen may comprise one or more suitable support members such as plastic, metal, wire, material, or the like, which support members may be affixed thereto to provide or enhance the stiffness of the screen thus further inhibiting such binding or bunching up of the same thereby further promoting the smooth retraction of the screen.

In a further preferred embodiment, the flexible screen may be tapered (for example having a greater height at a leading edge than the corresponding trailing edge) to further assist in inhibiting or obviating the above referenced binding or bunching up of the screen during retraction.

In yet a further preferred embodiment, the winding mechanism may further comprise a guide member having a surface of sufficient diameter and oriented substantially perpendicular to the flexible screen to guide the screen upon retractably receiving the same. The guide member may be formed integrally with the winding mechanism or coupled thereto as a discrete component, including, but not limited to, aftermarket installation.

Figure 27:
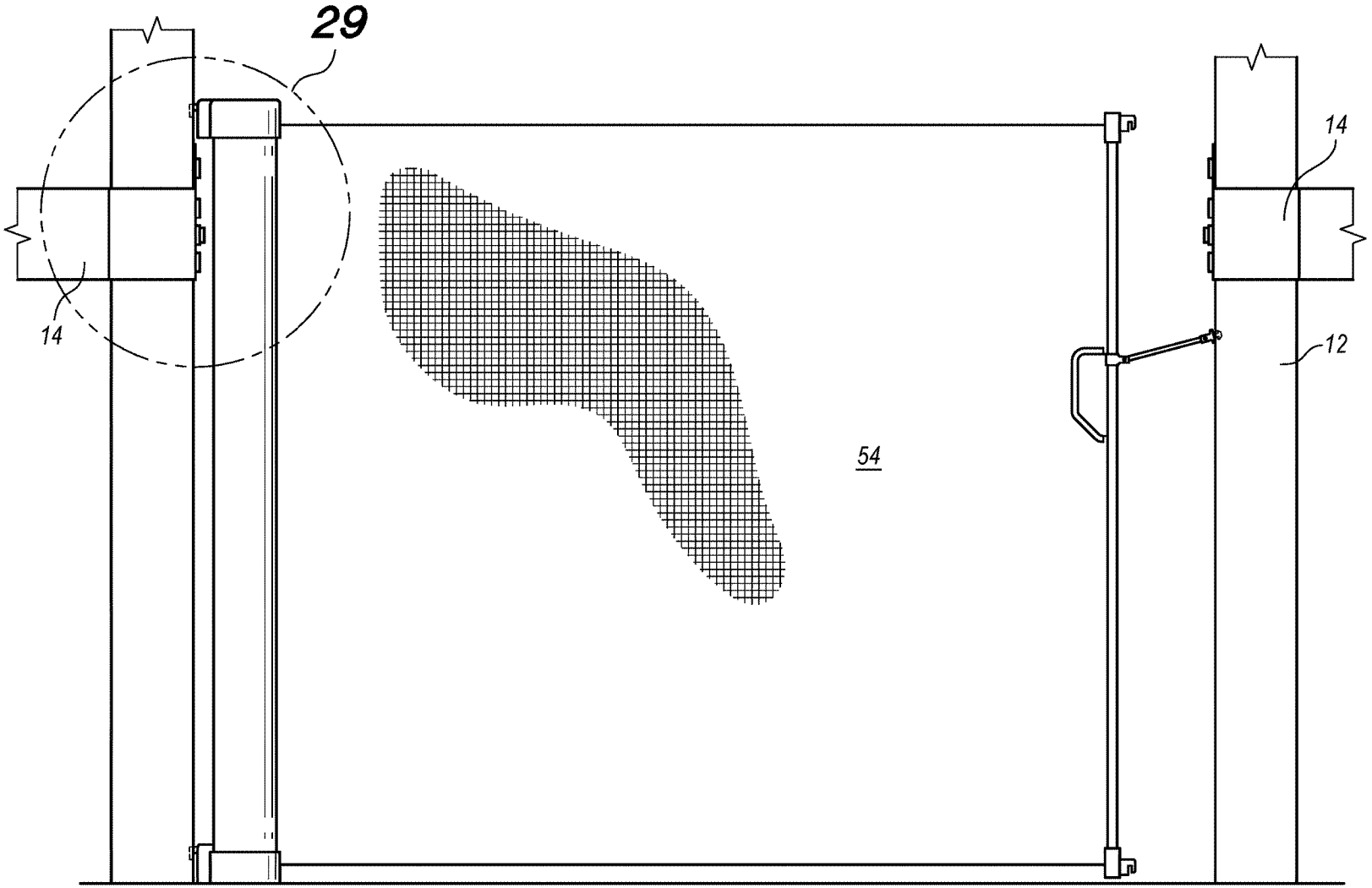
Figure 28:
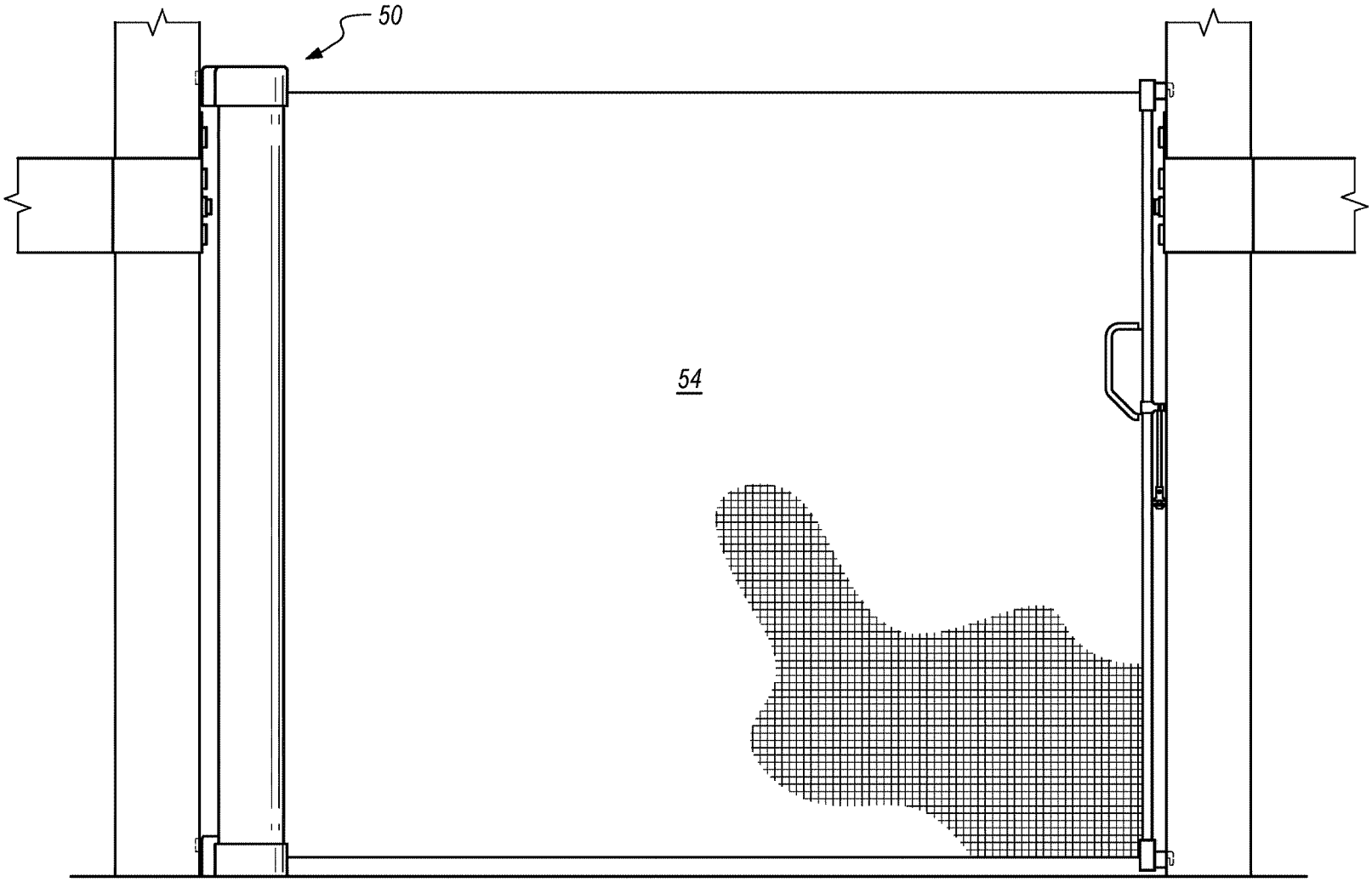
Figure 29:
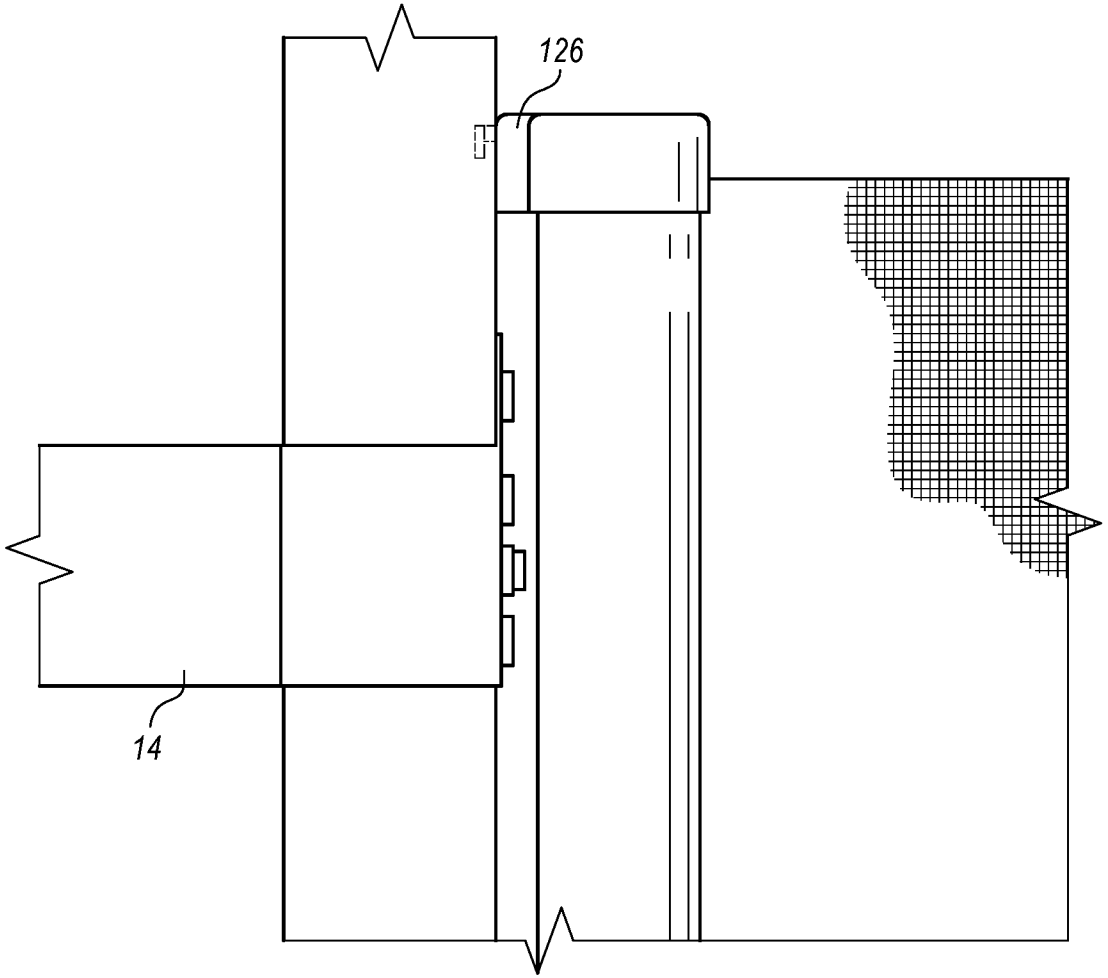
Figure 30:
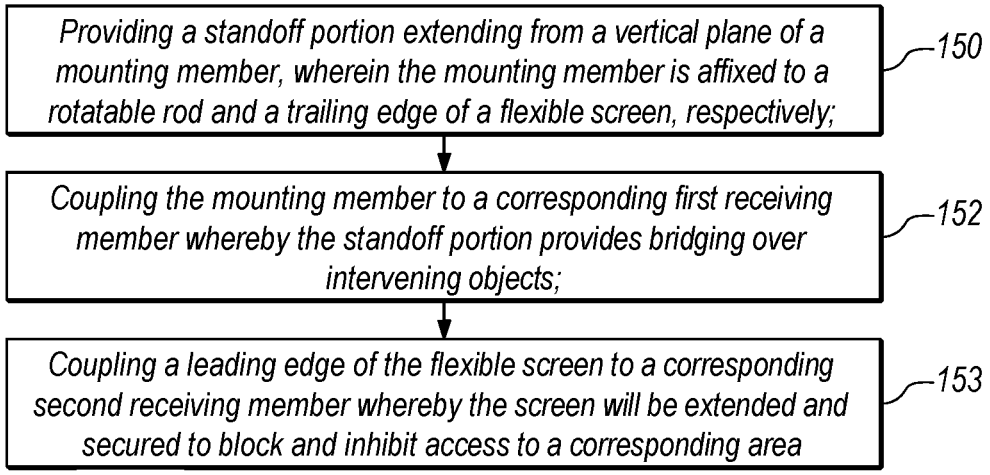

FIG. 27 is a partial side elevation view of the retractable barrier system of FIGS. 22-26 shown engaged with an exemplary first receiving post of a pallet rack assembly and illustrating in detail the coupling and bridging effect provided by the set-off portion with regard to intervening objects such as installed rack members, shelving units, and fasteners;

FIG. 28 is a partial side elevation view of the retractable barrier system of FIGS. 22-26 shown engaged with an exemplary first receiving post of a pallet rack assembly and illustrating in detail the coupling and bridging effect provided by the set-off portion with regard to intervening objects such as installed rack members, shelving units, and fasteners;

FIG. 29 is a partial side elevation view of the retractable barrier system of FIGS. 22-26 shown engaged with an exemplary first receiving post of a pallet rack assembly and illustrating in detail the coupling and bridging effect provided by the set-off portion with regard to intervening objects such as installed rack members, shelving units, and fasteners;

FIG. 30 is a flow diagram of representative method steps of the present invention.

BEST MODE FOR CARRYING OUT THE INVENTION

Figure 1:
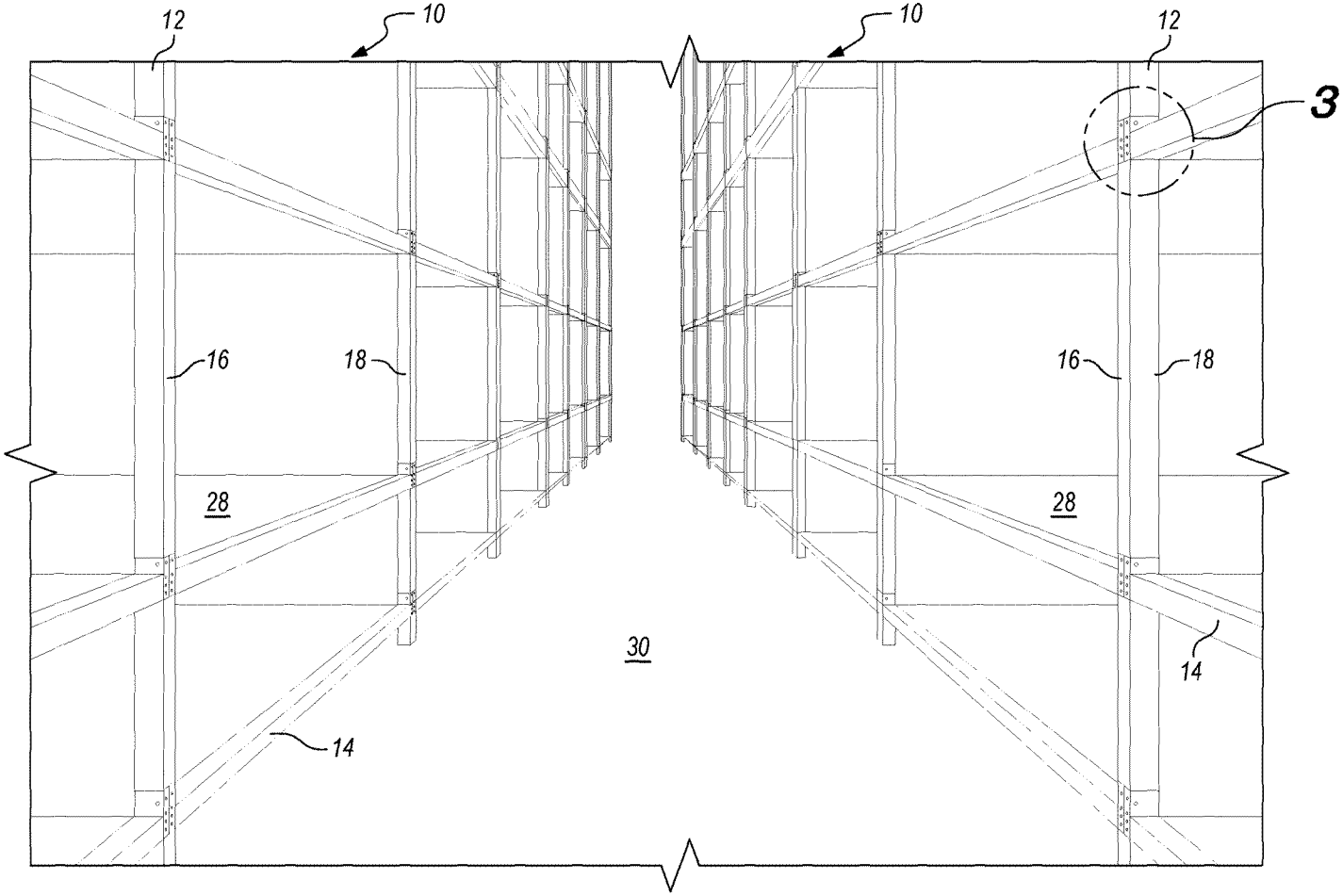
FIG. 1 PRIOR ART
FIG. 1 is a perspective diagram of a conventional pallet rack system as implemented in a retail or warehouse environment and shown defining a corresponding storage and/or shopping aisle as one exemplary application of the retractable barrier system of the present invention.
Figure 2:
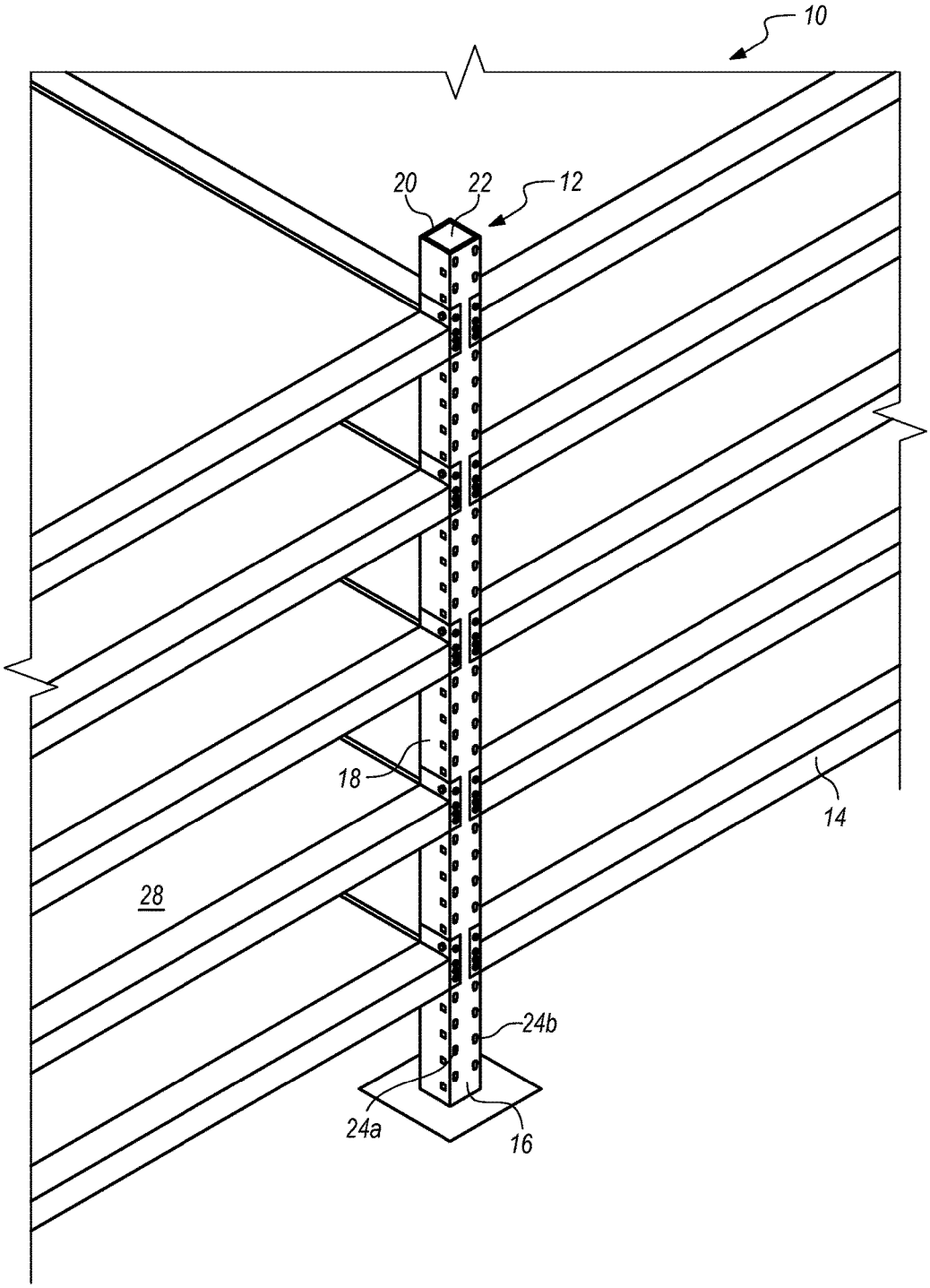
FIG. 2 PRIOR ART
FIG. 2 is an exploded perspective diagram of the exemplary pallet rack system of FIG. 1.
Figure 3:
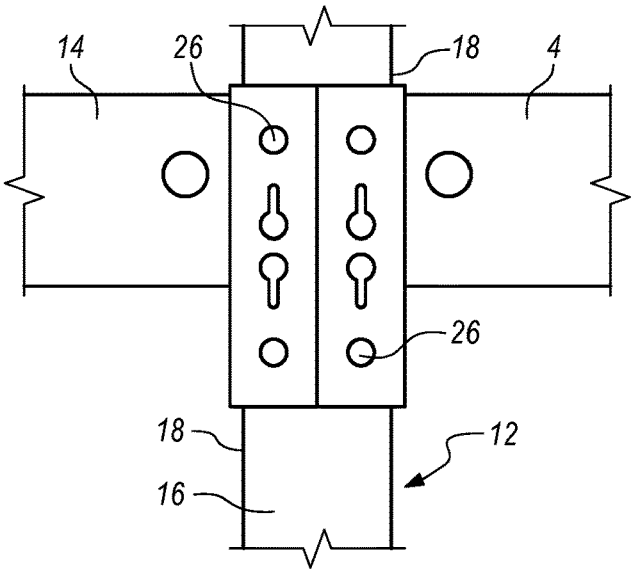
FIG. 3 PRIOR ART
FIG. 3 is a front elevation view showing the detail of the area designated by reference numeral 3 in FIG. 1.

With reference to FIGS. 1-2 of the drawings, there is provided perspective diagrams of an exemplary pallet rack shelving system or assembly 10 suitable, but not required, for use with the present invention. As those skilled in the art will recognize, assembly 10 includes a plurality of support posts 12 for receiving corresponding horizontal connecting lengths (not shown) and vertically spaced horizontal rack beams 14. Each support post 12 generally comprises a single piece of metal having an outwardly faced post section or margin 16, parallel side post sections or margins 18, and an opposed terminal end section or margin 20 defining a substantially square or rectangular post cross section 22.

As shown more fully in the exploded perspective view of FIG. 2, the outwardly facing post sections 16 and parallel post sections 18 are each typically provided with at least a row of vertically spaced stamped apertures such as keyhole slots 24 and preferably, but not necessarily, two rows thereof defining horizontally spaced aperture or slot pairs 24*a* and 24*b*. The slots 24 in each slot pair (24*a*, 24*b*) may be angularly related to one another to allow a better fit for components being attached to the rack 10, including the above referenced rack beams 14. The support posts 12 are secured together in any suitable relation by the horizontal connecting lengths, as referenced above, as well as a series of corresponding truss legs or the like (not shown).

Characteristically, the connecting lengths are affixed to opposing terminal post end sections 20 and/or parallel side post sections 18 by threading and securing one or more fasteners such as bolts 26 (including but not limited to hex bolts, carriage bolts, flange bolts, and the like) through the corresponding apertures 24. A plurality of vertically spaced horizontal rack beams 14 are affixed to opposing parallel side post sections 18 (and often the corresponding outwardly faced post sections 16 as well thus occupying multiple keyholes 24 in at least one vertical row) by similarly threading and securing one or more bolts 26 through the corresponding post section apertures 24. Each horizontal rack beam 14 is typically comprised of sheet metal having a ledge or lip (not shown) for receiving and supporting a wooden plank or other suitable shelving material 28 such as sheet metal decking or the like, which in turn receives and supports product for storage and display. The placement of opposing pallet rack assemblies 10 in such retail and warehouse environments defines corresponding and generally parallel aisles 30 in relation thereto as shown in FIG. 1.

Figure 4:
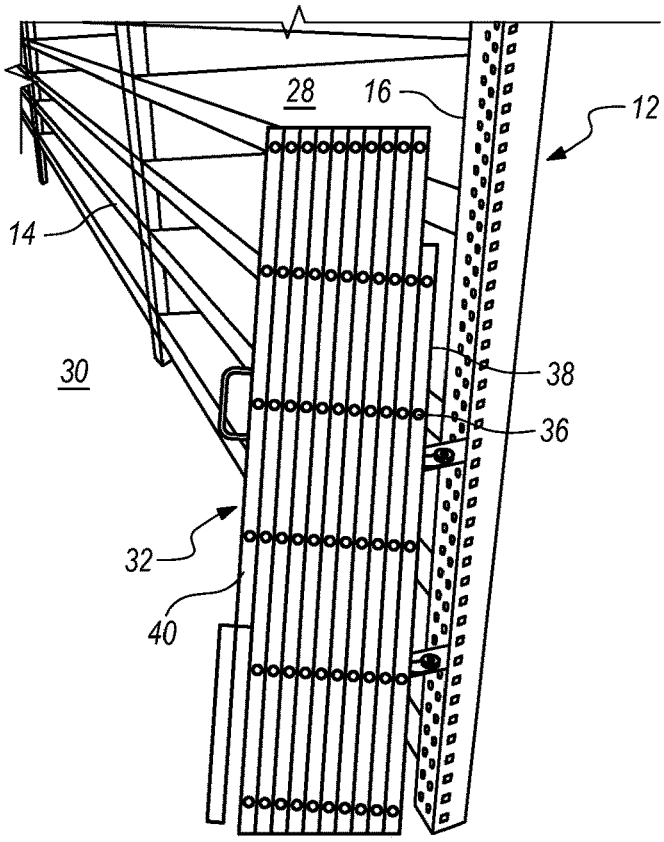
FIG. 4 PRIOR ART
FIG. 4 is a perspective diagram of a prior art accordion gate shown affixed to the exemplary pallet rack system of FIG. 1 in a retracted storage position as implemented in a retail or warehouse environment.
Figure 5:
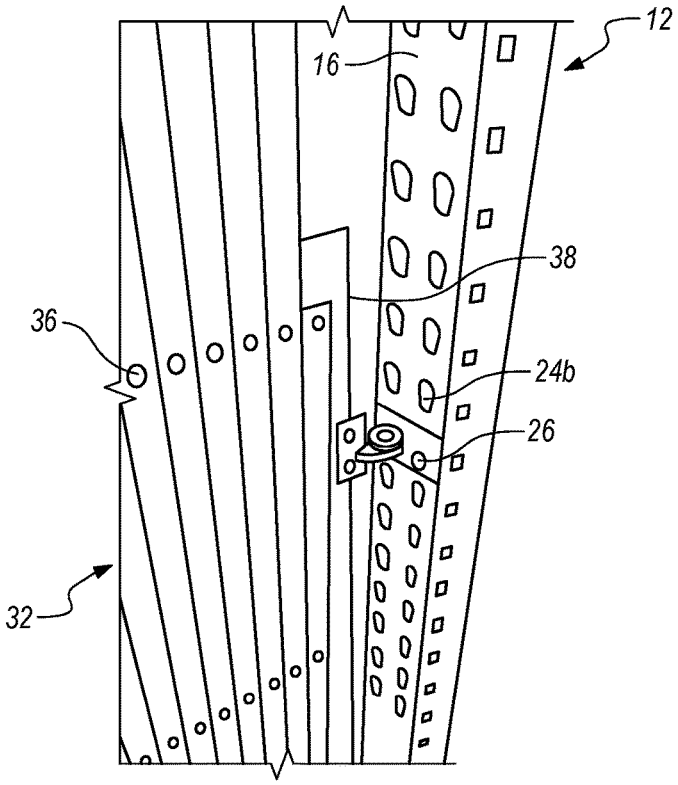
FIG. 5 PRIOR ART
FIG. 5 is an exploded perspective diagram of the accordion gate of FIG. 4.
Figure 6:
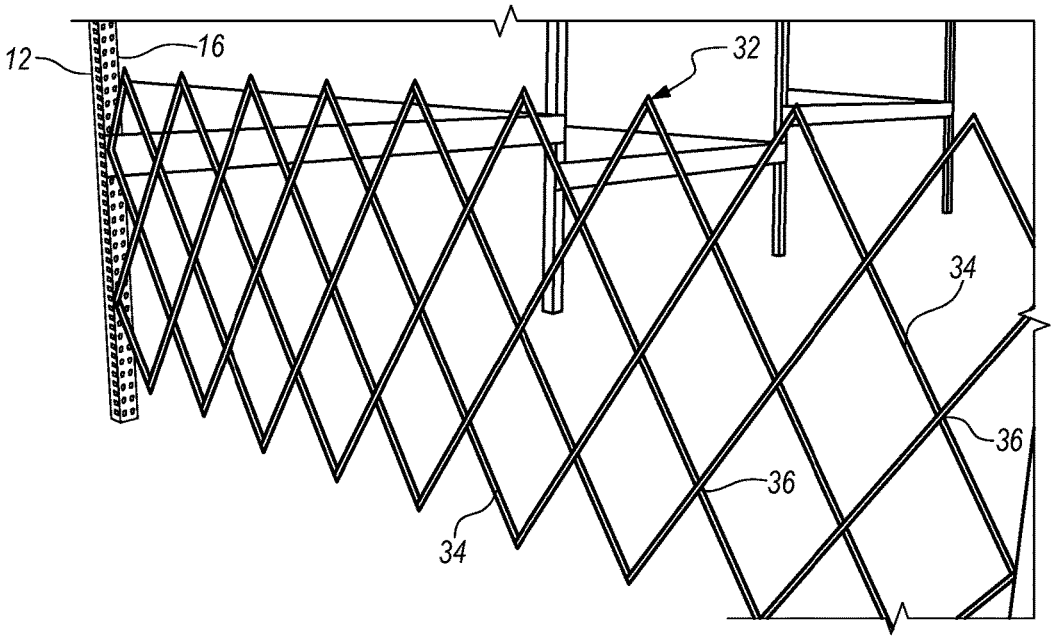
FIG. 6 PRIOR ART
FIG. 6 is a perspective diagram of FIGS. 4-5 shown in an extended position as implemented in a retail or warehouse environment to prevent access to a corresponding entryway or aisle.
Figure 7:
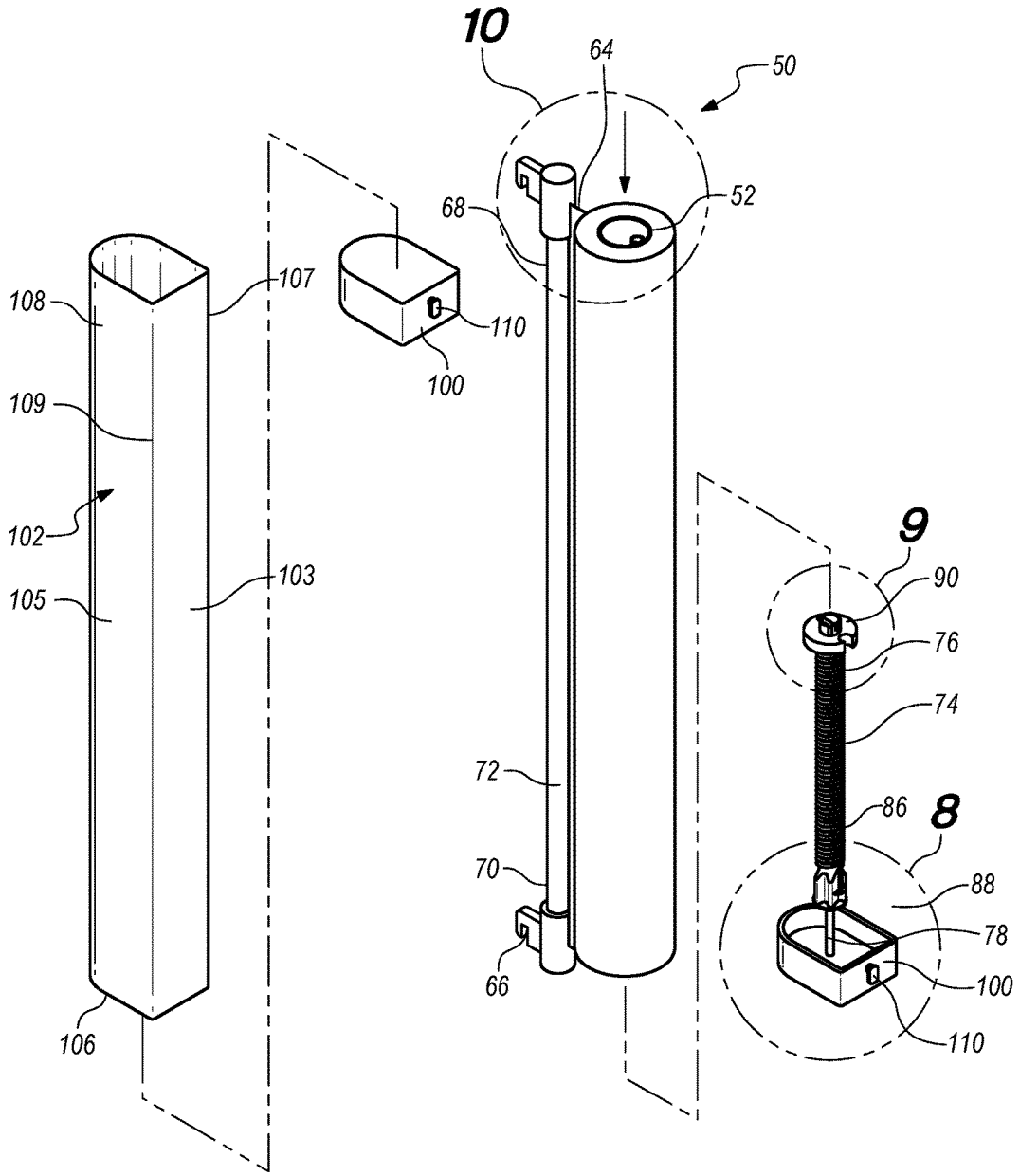
FIG. 7 is an exploded perspective diagram of exemplary components of a preferred, but not required, embodiment of the retractable barrier system of the present invention.
Figure 8:
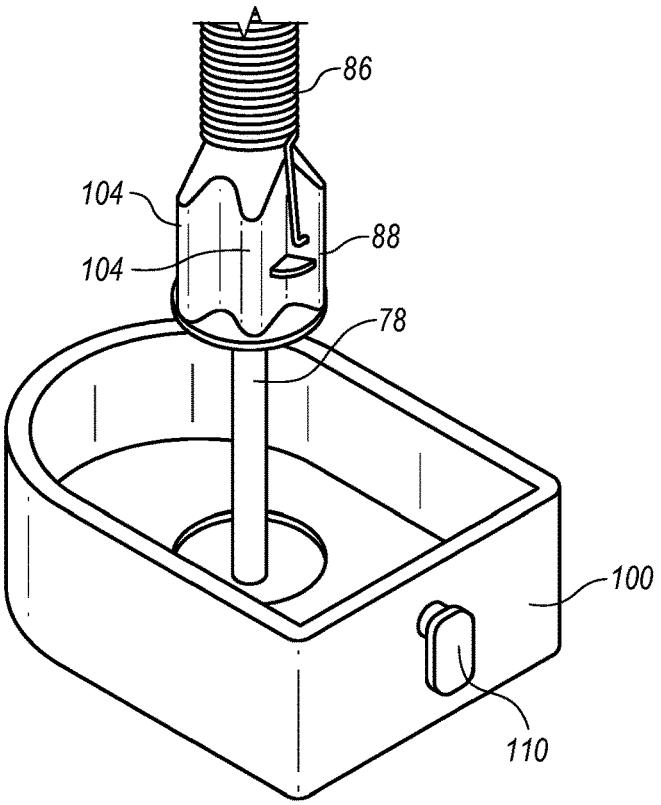
FIG. 8 is a detailed perspective diagram of a respective component of the retractable barrier system of FIG. 7.
Figure 9:
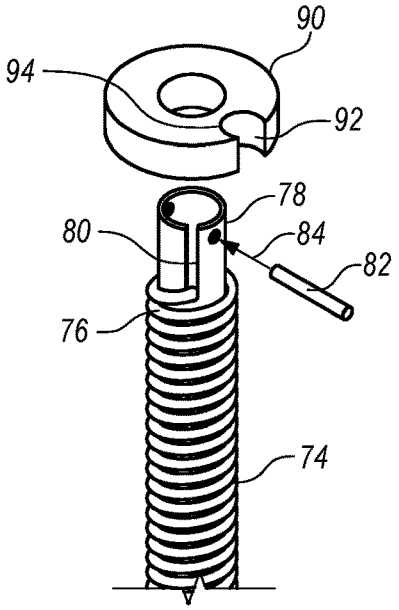
FIG. 9 is a detailed perspective diagram of a respective component of the retractable barrier system of FIG. 7.

Turning now to FIGS. 4-6 of the drawings, there is shown perspective diagrams of a prior art accordion or "scissor-style" retractable gate 32 as implemented in an aisle of opposing conventional pallet rack assemblies 10. As discussed above, accordion gate 32 comprises a plurality of accordion elements or members 34 interconnected and movable about pivot points 36. Accordion members 34 cooperate together to permit gate 32 to be unitarily extensible and retractable, as limited only by the number and length of such elements 34. As shown, accordion gate 32 is typically mounted in an aisle 30 at its trailing gate end 38 to receiving outwardly facing post sections 16 by threading one or more fasteners such as bolts 26 through corresponding receiving keyholes or apertures 24 stamped in the respective components. When not required for use, gate 32 is typically, but not necessarily, secured to receiving posts 12 in a substantially (but not completely) retracted storage position, limited by the number and width of extensible accordion elements 34, using chains, flexible cord, or other suitable retention devices (not shown). When it is subsequently desirable to block and inhibit access to a corresponding entryway or aisle 30, the retention device is removed or disabled, whereupon the gate 32 may be extended and secured at its leading end 40 to a corresponding opposing and receiving outwardly facing post section 16 of a receiving post 12 in the same or similar manner using one or more fasteners such as bolts 26 threaded through receiving keyholes or apertures 24.

As readily seen, the multiple movable accordion elements 34 increase the size, weight, and complexity of the corresponding gate 32, which in turn, correspondingly increases the associated costs of manufacture, shipping, maintenance, and repair of the same. As also indicated above, the foregoing installation common to such accordion gates, namely securing the same at trailing edges 38 in retracted storage positions with chains and flexible cord, may result in decreased visibility of products or signage stored or displayed in proximity to the gate, particularly at or near pallet end caps or shelving units. Still further, accordion gate 32 may extend or otherwise protrude, even in a stored and secured position, an undesirable distance into corresponding aisles 30 thus creating potential obstructions for shopping carts and machinery that may result in damage to the same and/or gate 32.

Turning now to FIGS. 7-13 of the drawings, there is provided exploded perspective diagrams and detailed views of exemplary components of the retractable and flexible barrier system 50 of the present invention. As discussed above, system 50, by way of example, but not limitation, may be provided for use with a conventional pallet rack system or assembly 10 or posts or brackets (not shown) having the same or similar functionality thereof including receiving apertures 24 and preferably, but not necessarily, aperture rows defining aperture row pairs 24*a* and 24*b*.

System 50 may therefore include at least a rotatable elongate mounting rod 52 that may be directly or indirectly affixed to a trailing edge 56 of a flexible screen 54 and a corresponding receiving member such as by way of example, but not limitation, an outward facing post section 16 or side post section 18 of a conventional pallet post 12 or other suitable bracket through corresponding receiving apertures such as keyhole slots 24. Mounting rod 52 may comprise any suitable material including, but not limited to, extruded aluminum. The referenced trailing edge 56 of flexible screen 54 may be affixed to mounting rod 52 in any suitable manner. In the preferred embodiment shown, mounting rod 52 is provided with an elongate annular notch 58 that spans a sufficient vertical length of mounting rod 52 such that a concave portion 60 thereof may receive a mounting tube 62 affixed to the trailing edge of flexible screen 54. Mounting tube 62 similarly spans a sufficient vertical length of flexible screen 54 and may be affixed thereto by any suitable means including adhesive. As shown, mounting tube 62 may be inserted into the concave notch portion 60 of mounting rod 52 to secure flexible screen 54 to mounting rod 52. Screen 54 may thereafter be wound about mounting rod 52 as will be discussed in further detail below. Again, mounting tube 62 may comprise any suitable material and may be affixed to the trailing edge 56 of flexible screen 54 in any suitable manner including, but not limited to, mechanical attachment, adhesive, or melting/fusing the components together. In the latter case, mounting tube 52 may be comprised of plastic or other material capable of being adhered to flexible screen 54 by applying heat and/or pressure, or the like.

Flexible screen 54 may comprise or include any suitable material or fiber including cloth, canvas, plastic, wire, paper, netting, and the like, or any combination thereof that may be readily and easily retracted about mounting rod 52 when the barrier 50 is disengaged, and extended therefrom when the barrier 50 is intended to be engaged as necessary to span an entryway or other designated private or public area 30 whether indoors or outdoors. Flexible screen 54, by nature of its unitary, flexible, and retractable design, is also amenable to having pre-printed wording or signage placed thereon including of any suitable nature and provided for display at a plurality of extension or recoil positions. For example, such wording or signage may be placed at or near a leading edge 64 for intended display when screen 54 is partially extended, at or near trailing end 56 for intended display when screen 54 is fully extended, or anywhere therein between. Such wording or signage may also be printed on opposing sides of the screen 54 and positioned thereon at any suitable location to prevent ink seepage or message interference, depending on the translucency and type of barrier material being used.

Still referring to FIGS. 7-13, in this exemplary application, flexible screen 54 is further provided with an attachment mechanism 66 operative to couple a leading edge 64 thereof to an outward facing post section 16 or side post section 18 of one or more pallet posts 12 or other suitable brackets or bracket sections. Attachment mechanism 66 may comprise one or more hook brackets that may be affixed at top and/or bottom ends 68 and 70 of the leading edge 64 of screen 54 or any other suitable position there between. For example, hook brackets 66 may be affixed near the center or midpoint between the respective top and bottom ends 68 and 70 to provide quicker and easier connection and disconnection by a user. Hook brackets 66 may also be, but are not required to be, rotationally movable about a vertical axis thereof to permit easy connection with any suitable outward facing post section 16 or side post section 18 of a corresponding pallet post 12 or bracket depending upon the installation. As shown, hook brackets 66 may be affixed to respective ends of an attachment rod or pull member 72. Pull member 72 is further affixed to leading edge 64 of flexible screen 54 by any suitable means, including adhesive. It is understood, however, that pull member 72 is provided in a preferred embodiment only, and may be eliminated without departing from the spirit or scope of the invention herein described.

A winding mechanism such as a conventional spring or, more preferably, but not necessarily, a torsion spring 74, is further provided as shown in the referenced FIGS. 7-13. As those skilled in the art will recognize, torsion springs are typically helical springs that function to exert a torque or rotary force. When twisted, a torsion spring thus exerts a force, actually torque, in the opposite direction that is proportional to the amount (angle) it is twisted. Characteristically, the respective ends of a torsion spring are attached to other components, and when those components rotate around the center of the spring, the spring exerts a counterforce in attempt to push the components back to their original position. While the name implies otherwise, so-called torsion springs are actually subjected to bending stress rather than torsional stress. In operation, such springs function to store and subsequently release substantial angular energy (mechanical energy) or statically hold a mechanism in place by deflecting the legs about a body centerline axis.

In the exemplary embodiment shown, torsion spring 74 is coupled at a top end 76 thereof to a shaft 78 and more particularly to a shaft slot 80. It is understood, however, that torsion spring 74 may of course be affixed and secured to shaft 78 by any suitable means including, but not limited to, the above-described shaft slot 78. Torsion spring 74 is further affixed at a bottom end 86 thereof to a bottom key or winding key 88. In keeping with the invention and the preferred embodiment shown and described, bottom key 88 freely rotates about the center axis of shaft 78 and functions to wind or "pre-load" torque onto torsion spring 74 prior to insertion into mounting rod (and wound barrier screen 54) as will be described in further detail below. There is also provided a top key 90 positioned at and affixed to the top end 76 of shaft 78. Like bottom key 88, top key 90 freely rotates about shaft 78, and more particularly, about top end 76 of shaft 78. Top key 90 is secured from removal from shaft 78 by roll pin 82 received within corresponding shaft apertures 84. Again, it is understood that any suitable means may be used to secure top key 90 from removal. Notably, top key 90 is not affixed to torsion spring 78. Rather, top key 90 includes an annular notch 92 that functions to guide the assembly (torsion spring 74 and shaft 78) into mounting rod 52. More specifically, concave portion 94 of top key annular notch 92 is received by convex portion 96 of mounting rod annular notch 58, as will be described in further detail below.

Still referring to FIGS. 7-13, the exemplary, but not required, embodiment shown and described includes top and bottom caps 98 and 100, respectively, and a housing 102. Again, the foregoing may comprise any suitable material including plastic, molded one piece aluminum, cast aluminum, extruded aluminum, and the like. In the preferred embodiment shown, top and bottom caps 98 and 100, also called top and bottom base caps, comprise cast aluminum and housing 102 comprises extruded aluminum. Bottom base cap 100 is affixed to shaft 78 in any suitable manner, including, for example by receiving shaft 78 within a receiving notch, aperture, or extension portion 101 affixed to or molded within bottom cap 100 and securing the same with a roll pin (not shown) so that shaft 78 is secured and oriented so it can't move. Once secured, bottom base cap 100 will rotate with shaft 78. Accordingly, once torsion spring 74 (affixed to shaft 78) is preloaded with torque to store mechanical energy, bottom cap 100 must be secured in place to prevent release of such energy. Housing 102 further includes a mounting sidewall 103 which is preferably, but not necessarily, substantially flat and coplanar along both its length and width, and at least a supplemental side wall 105 extending between housing first and second ends 106 and 108, respectively, to define an internal cavity. Housing 102 also includes an elongate vertically disposed opening (not shown) or slot for receiving and extending barrier screen 54 through the housing once assembled. As illustrated, in this preferred embodiment supplemental sidewall 105 is substantially rounded extending contiguously from opposing vertical edges 107 and 109 of mounting sidewall 103 about substantially a ninety-degree radius thereof. It is understood, however, that any suitable configuration and number of additional sidewalls, including no sidewalls, may be utilized without departing from the spirit, scope, and functionality of the disclosed invention.

Figure 10:
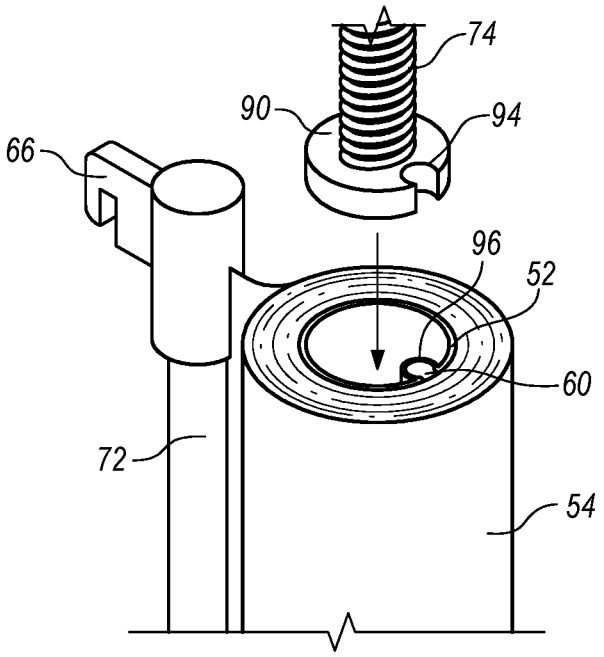
FIG. 10 is a detailed perspective diagram of a respective component of the retractable barrier system of FIG. 7.
Figure 11:
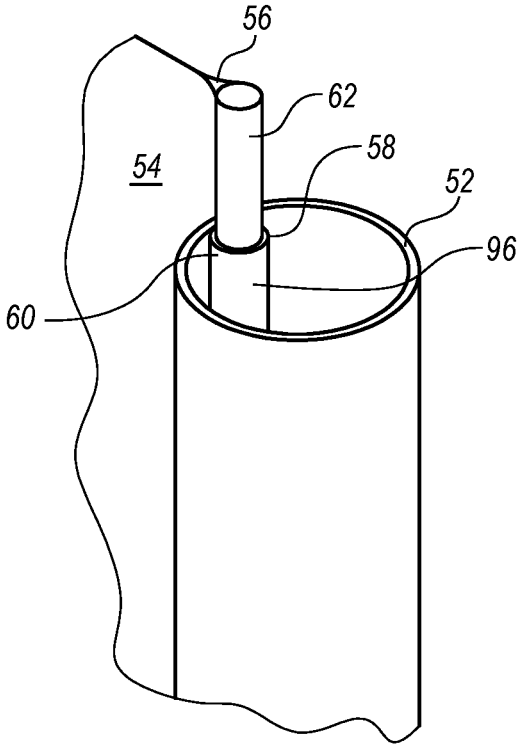
FIG. 11 is a detailed perspective diagram of a respective component of the retractable barrier system of FIG. 7.
Figure 12:
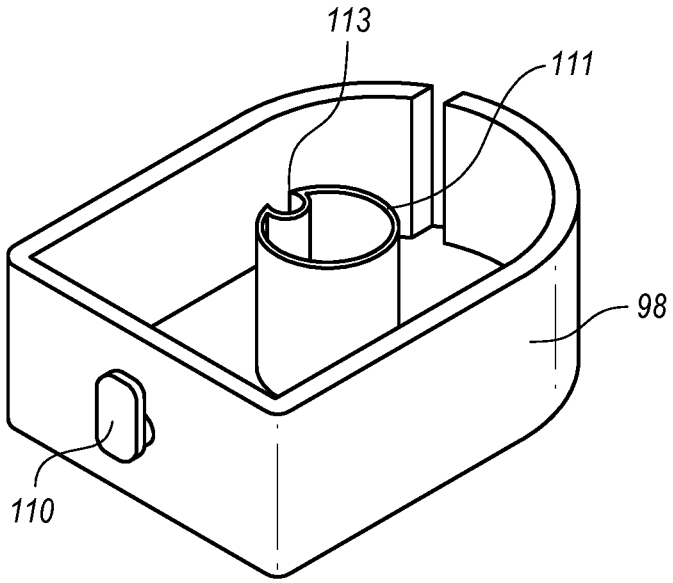
FIG. 12 is a detailed perspective diagram of a respective component of the retractable barrier system of FIG. 7.
Figure 13:
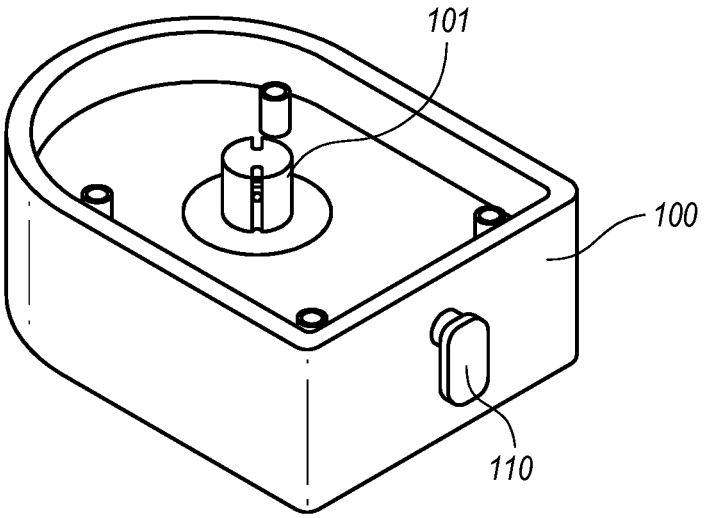
FIG. 13 is a detailed perspective diagram of a respective component of the retractable barrier system of FIG. 7.
Figure 14:
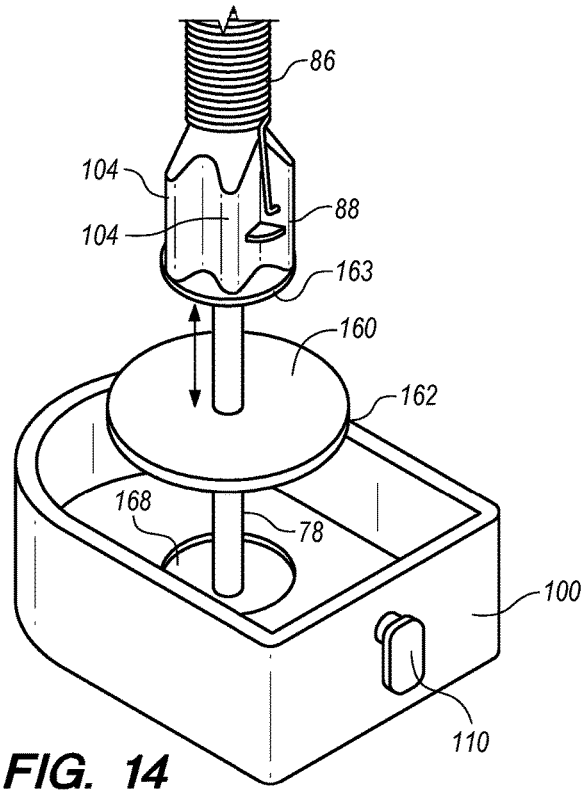
FIG. 14 is a detailed perspective diagram of a further preferred, but not required, embodiment of the retractable barrier system of FIG. 7.

Referring specifically to FIGS. 10 and 11, the steps for preloading spring 74 with torque and assembling the components of the referenced first preferred embodiment of the invention are described. Spring tension is first applied by rotating or winding base key (winding key) 88. While holding base cap 100 securely in place (as it is affixed to shaft 78), the entire assembly is inserted into mounting rod 52 using top key 90 and more particularly top key notch 94 as a guide for receipt by annular notch 52 and more particularly convex portion 96 thereof. Winding key 88 is thereafter secured in place similarly by mating adjacent ridges 104 with the same convex portion 96 of annular notch 52. Thereafter, bottom cap 100 is secured to bottom end 106 of housing 102 using any suitable fastener or fasteners such as screws or the like. Top cap 98 is similarly secured to top end 108 of housing 102 in like manner. As shown, top cap 98 includes guide 111 having an annular notch 113. Guide 111 functions to freely rotate within top cap 98. Specifically, annular notch 113 receives and mates with corresponding mounting rod notch 60 and even more specifically convex portion 96 thereof. Accordingly, mounting rod 52 may freely rotate within housing 102 about top and bottom caps 98 and 100. More specifically, top end of mounting rod 52 rotates about guide 11 and bottom end of mounting rod 52 rotates about bottom key 88 with preloaded torque applied thereto. In keeping with the invention, top and/or bottom caps 98 and 100 are further provided with lugs 110 or other suitable hook type or other mechanism for attachment to receiving apertures 24 of pallet rack posts 12 or brackets having the same or similar functionality. The assembled flexible barrier system 50 of the first preferred embodiment is shown in FIG. 14. FIG. 14 also includes an adjustable gate attachment mechanism of a second preferred embodiment as described below.

Figure 15:
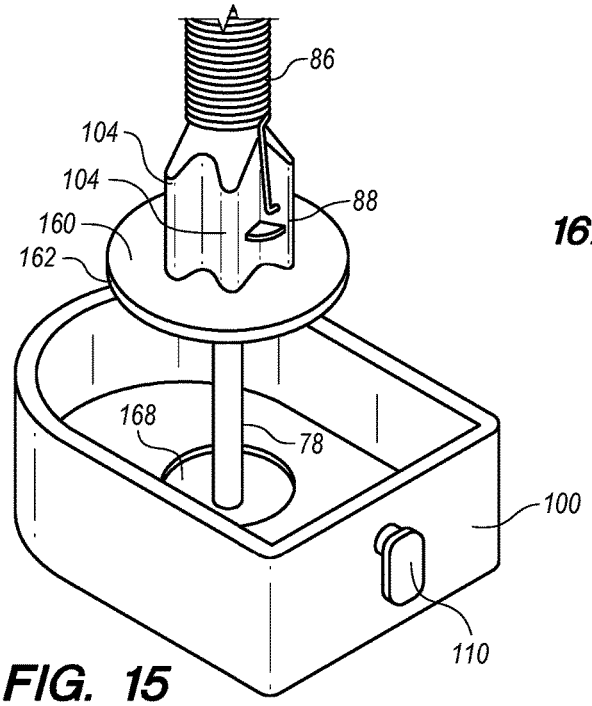
FIG. 15 is a detailed perspective diagram of a further preferred, but not required, embodiment of the retractable barrier system of FIG. 7.
Figure 16:
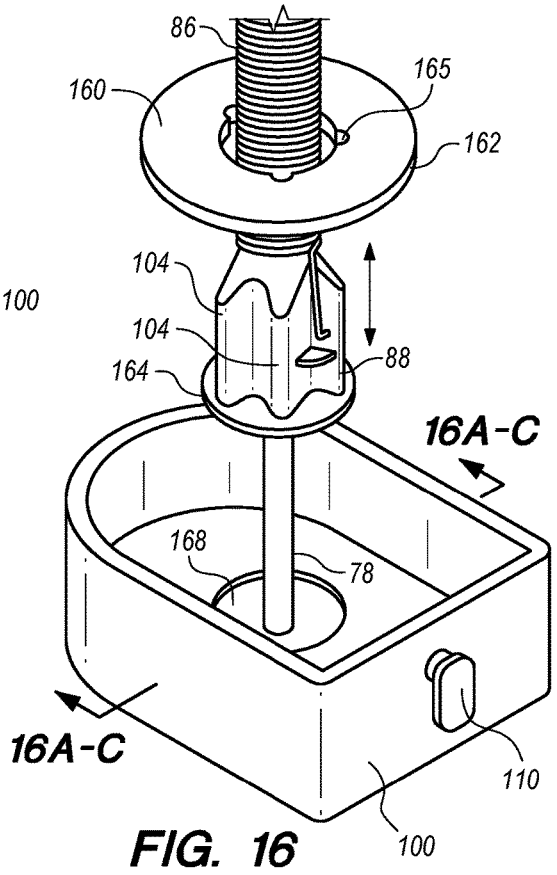
FIG. 16 is a detailed perspective diagram of a further preferred, but not required, embodiment of the retractable barrier system of FIG. 7.
Figure 16A:
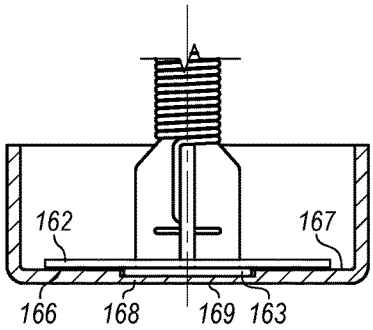
FIG. 16A is a cross-sectional view of the preferred embodiment of FIG. 16 taken along line 16A-C.

With reference to FIGS. 14-16, in a preferred embodiment, bottom winding key 88 may further comprise a guide member 162. Guide member 162 may comprise a separate component that may be coupled by any suitable means to a bottom surface 163 of bottom winding key 88 or a top surface or lip 164 of bottom winding key 88, as shown in FIGS. 14 and 16, respectively. In the latter case, guide member 162 may include one or more apertures or cut out portions 165 as necessary to slide or otherwise fit over shaft 78 and torsion spring 86. Alternatively, guide member 162 may be integrally formed with bottom winding key 88 as shown in FIG. 15. Guide member 162 may comprise any suitable and preferably substantially rigid material including, but not limited to plastic, and is preferably, but not necessarily disk-shaped. It is understood, however, that any suitable size or shape may be utilized provided the objectives below are achieved. Guide member 162 may also be affixed to bottom key 88 in any suitable manner including, but not limited to, adhesive, screws or bolts, or other fastener or fastening means. In keeping with the invention, guide member 162 includes a surface portion 160 having a sufficient diameter and oriented substantially perpendicular or normal to the flexible screen 54 to guide and promote substantially smooth extension and retraction of the screen 54 (i.e. inhibit binding or "bunching up") thus permitting the use of flexible screens comprising a greater array of materials and textures including those having a more "tacky" or "rubbery" composition, texture or feel.

In further preferred embodiment, flexible screen 54 may be cut tapered in height from the leading edge 64 to the trailing edge 56 thereof, so as to further assist in promoting the smooth retraction and extension of flexible screen 54. In such case, leading edge 64 may have a height that is greater than the height of the trailing edge 56 with the above-referenced tapering there between preferably, but not necessarily, in equal amounts at both the top and bottom portions of the trailing edge 56. The specific tapering, amount, and location thereof will depend in large part on the relative heights of the respective leading and trailing edges, the length or span of the flexible gate 54, the selected gate material, materials or composite construction, the corresponding modulus of elasticity of the foregoing, the resulting flexibility or "pliability" thereof, as well as the specific application. By way of example, but not limitation, leading edge 64 may have an exemplary height of 40 inches, the flexible gate may have a length or span of 6 feet, and the trailing edge 54 may be tapered equally a half inch at both the top and bottom portions thereof defining a trailing edge height of 39 inches. Of course, greater or less tapering as well as different tapering locations (including at the leading edge 64, the trailing edge 56, or both edges) and patterns may be employed to achieve different results and will provide different corresponding appearances of the flexible gate 54 upon being installed and extended. The above referenced tapering amounts and location are provided as exemplary of a preferred embodiment only wherein minimal tapering has been provided to achieve the objective of inhibiting binding or bunching up of the gate upon retraction and/or extension without substantially altering the appearance of the flexible screen 54 once extended (i.e. to appear upon casual inspection to have a uniform or near uniform height across the length or span of screen 54 once extended). Different tapering amounts and locations are thus anticipated depending on the application and desired performance (required flexibility or alternatively the lack of rigidity) and appearance of screen 54.

As those skilled in the art will recognize, and as referenced above, the rigidity of the material of screen 54 may more properly be referred to as its elastic modulus also known as its modulus of elasticity. Practically speaking, elastic modulus is not the same as stiffness. Elastic modulus is a property of the constituent material; stiffness is a property of a structure. Accordingly, modulus of elasticity is an intrinsic property of the material, whereas stiffness is an extrinsic property of a body dependent on the material and the shape of the boundary conditions. Modulus of elasticity is thus a prime property to be considered when selecting the above referenced screen material to achieve the desired stiffness of the resulting gate. In short, the modulus of elasticity must be sufficiently low to provide the required flexibility yet sufficiently high to inhibit or obviate undesirable binding or "bunching up" of the screen that might otherwise result particularly during retraction. More specifically, and in keeping with the invention herein, the modulus of elasticity of the screen material or materials must be sufficiently high such that the screen has sufficient stiffness to inhibit sagging or bowing of the same upon extension thus promoting the smooth retraction thereof by conversely obviating potential binding or bunching up of the gate which might otherwise result during retraction.

Figure 16B:
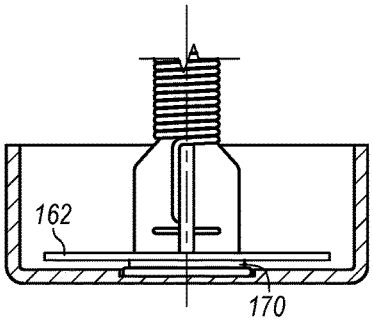
FIG. 16B is a cross-sectional view of an alternative embodiment of FIG. 16 taken along line 16A-C.
Figure 16C:
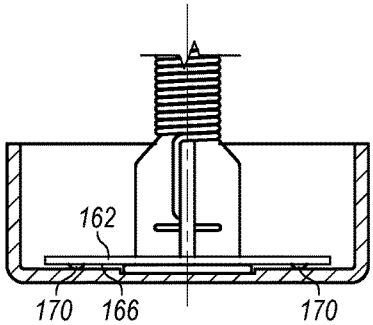
FIG. 16C is a cross-sectional view of an additional alternative embodiment of FIG. 16 taken along line 16A-C.
Figure 16D:
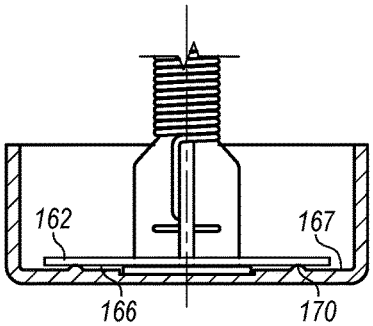
FIG. 16D is a cross-sectional view of an additional alternative embodiment of FIG. 16 taken along line 16A-C.
Figure 16E:
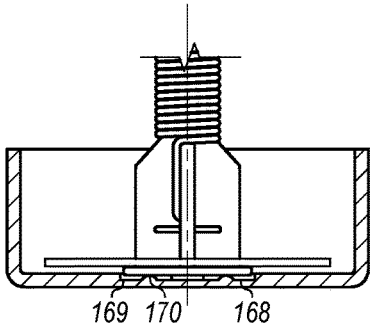
FIG. 16E is a cross-sectional view of an additional alternative embodiment of FIG. 16 taken along line 16A-C.

In further keeping with the invention, a variety of spacers 170 may also be provided to reduce friction between guide member 162 and bottom cap 100. More specifically, such spacers 170 may be provided to reduce friction between bottom surface 166 of guide member 162 and top surface 167 of bottom cap 100. See, for example, FIG. 16A wherein guide member 162 is shown affixed to top surface 164 of bottom winding key 88. As readily seen, in the absence of a spacer 170, bottom surface 164 of guide member 162 is received within recessed portion or cavity 168 formed in bottom cap 100. Accordingly, depending on the thickness of the corresponding bottom winding key portion received within cavity 168 and/or the depth of cavity 168, bottom surface 166 of guide member 162 may directly contact top surface 167 of bottom cap 100 resulting in undesirable friction which may impede the smooth retraction and/or extension of gate 54. Accordingly, as shown in FIGS. 16B-16E, a variety of spacers 170 may be provided to reduce or eliminate such contact and thus reduce or eliminate the resulting friction. Spacers 170 may comprise an additional disk having any suitable composition, rigidity, orientation, and dimension (FIG. 16B). Spacers 170 may also comprise one or more raised portions such as buttons, nubs, ridges, or the like, coupled to or formed integral with either or both of the relative contacting surfaces. Thus, with reference to 16C, raised portions 170 may be provided on the bottom surface 166 of guide member 162. Similarly, as shown in FIG. 16D, raised portions 170 may alternatively, or additionally be provided on top surface 167 of bottom cap 100. Yet still further, as shown in FIG. 16E, raised portions 170 may alternatively or additionally be formed on or coupled to the top surface 169 of recessed portion 168 of bottom cap 170. While FIGS. 16A-16E illustrate placement of spacers 170 where guide member 162 is coupled to a top surface 164 of bottom key 88, a similar placement may be used in the case where guide member 162 is either formed integral with bottom key 88 or coupled to a bottom surface 163 of bottom key 88. As readily understood, in either case, bottom surface 166 of guide member 162 may directly contact top surface 167 of bottom cap 100 in the absence of a spacer. Accordingly, the aforementioned spacing approaches may be utilized to reduce or eliminate undesirable friction resulting from such direct contact. Again, spacer 170 may comprise an additional disk having any suitable composition, pliability, orientation, and dimension and may be disposed between bottom surface 166 of guide member 162 and top surface 167 of bottom cap 100. Alternatively, one or more raised portions 170 such as buttons, nubs or ridges may be coupled to or formed integral with either or both of the relative contacting surfaces.

In yet a further preferred embodiment provided to achieve the desired performance above, one or more support members may be coupled to screen 54 at suitable locations to enhance the stiffness/rigidity of the screen 54, particularly, but not necessarily, limited to the vertical direction, beyond that of the elastic modulus of the selected screen material. By way of example, but not limitation, one or more flexible battens or the like comprising fiberglass, plastic, rubber, wire, or any suitable material or composition, including any combination of the foregoing, may be coupled to screen 54, again preferably, but not necessarily in the vertical direction, including for example, but not limitation, by insertion into one or more predefined receiving receptacles such as batten pockets commonly used in sails. The foregoing battens may be coupled or placed at any suitable location and orientation including along any portion or the entire span of the top and/or bottom edges and/or the leading or trailing edges of screen 54 or anywhere there between, including extending inward at any angle from any such edge.

Figure 17:
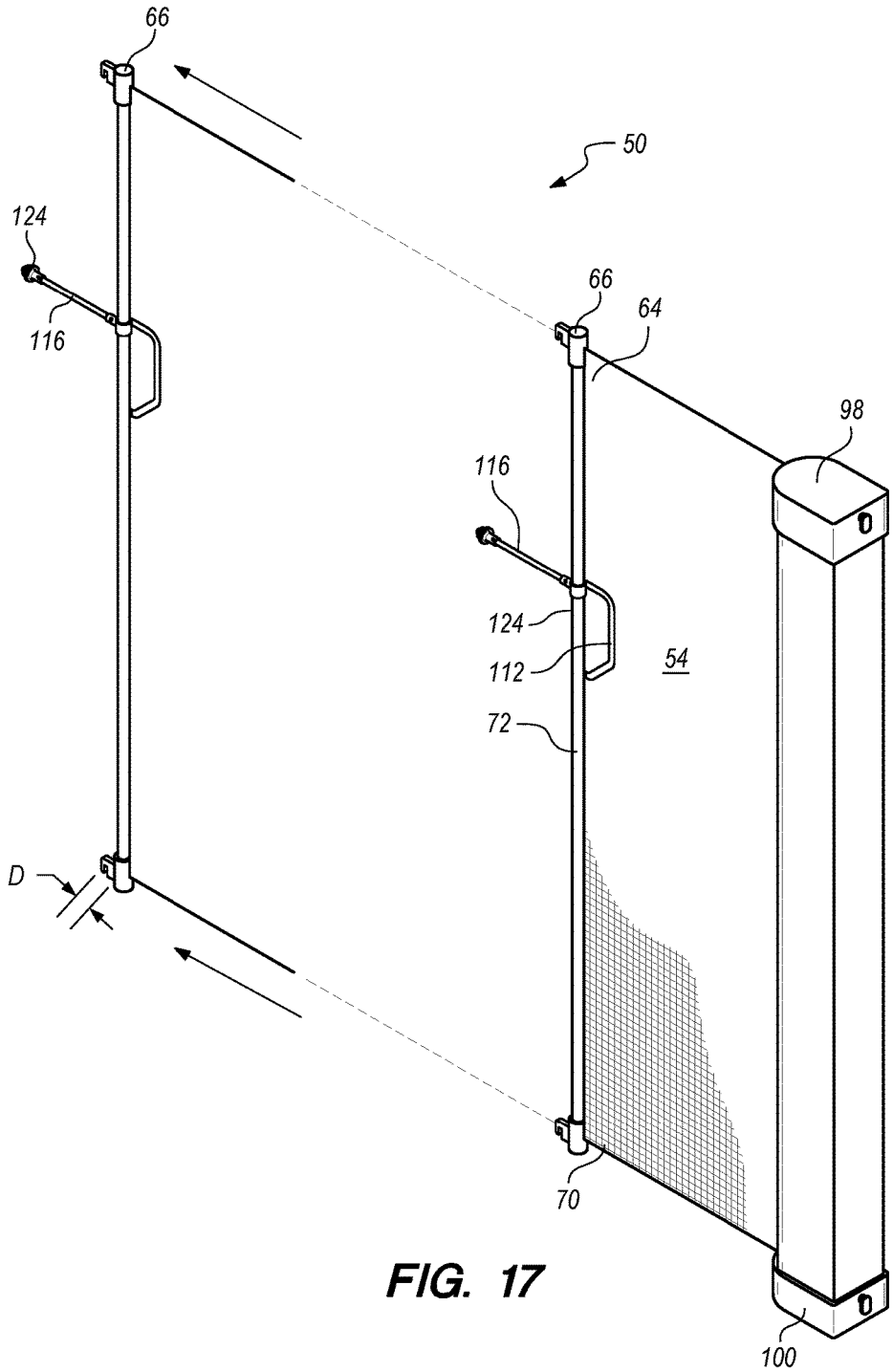
FIG. 17 is a perspective diagram of a further preferred, but not required, embodiment of the retractable barrier system of the present invention shown disengaged from receiving posts in an exemplary application and illustrating the extension path of the corresponding flexible screen.
Figure 19:
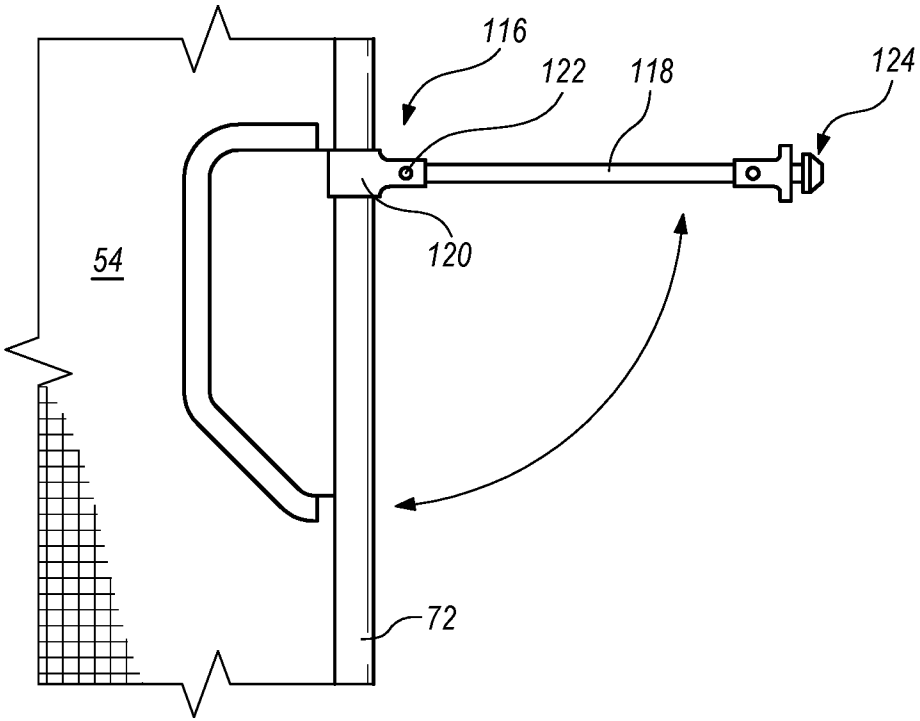
FIG. 19 is a partial perspective diagram of the embodiment of FIG. 13 illustrating in detail the exemplary, but not required, adjustable attachment mechanism provided therein.
Figure 18:
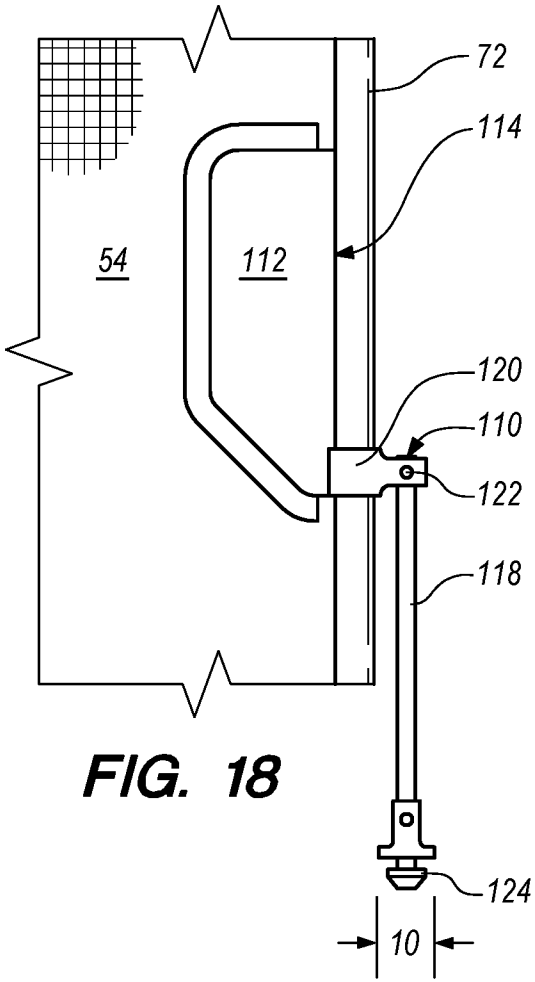
FIG. 18 is a partial perspective diagram of the embodiment of FIG. 13 illustrating in detail the exemplary, but not required, adjustable attachment mechanism provided therein.

With reference to FIGS. 17-19, in a still further preferred embodiment, flexible screen 54 may include a cutout section 112 disposed at any suitable location defining a cutout handle 114 bounded by the flexible screen 54 and if provided, pull member 72. System 50 may further include an adjustable gate attachment member 116. Gate attachment member 116 may comprise any suitable element operative to bridge intervening objects or provide temporary coupling to a suitable receiving aperture of a support post 12 or corresponding bracket having the same or similar functionality. For example, gate attachment member 116 may comprise a tethered or retractable arm or member (for example comprising elastic cord or cable and disposed within and extensible from pull member 72) as well as any rigid or flexible arm or extensible member affixed to the leading edge 64 of flexible screen 54.

Figure 20:
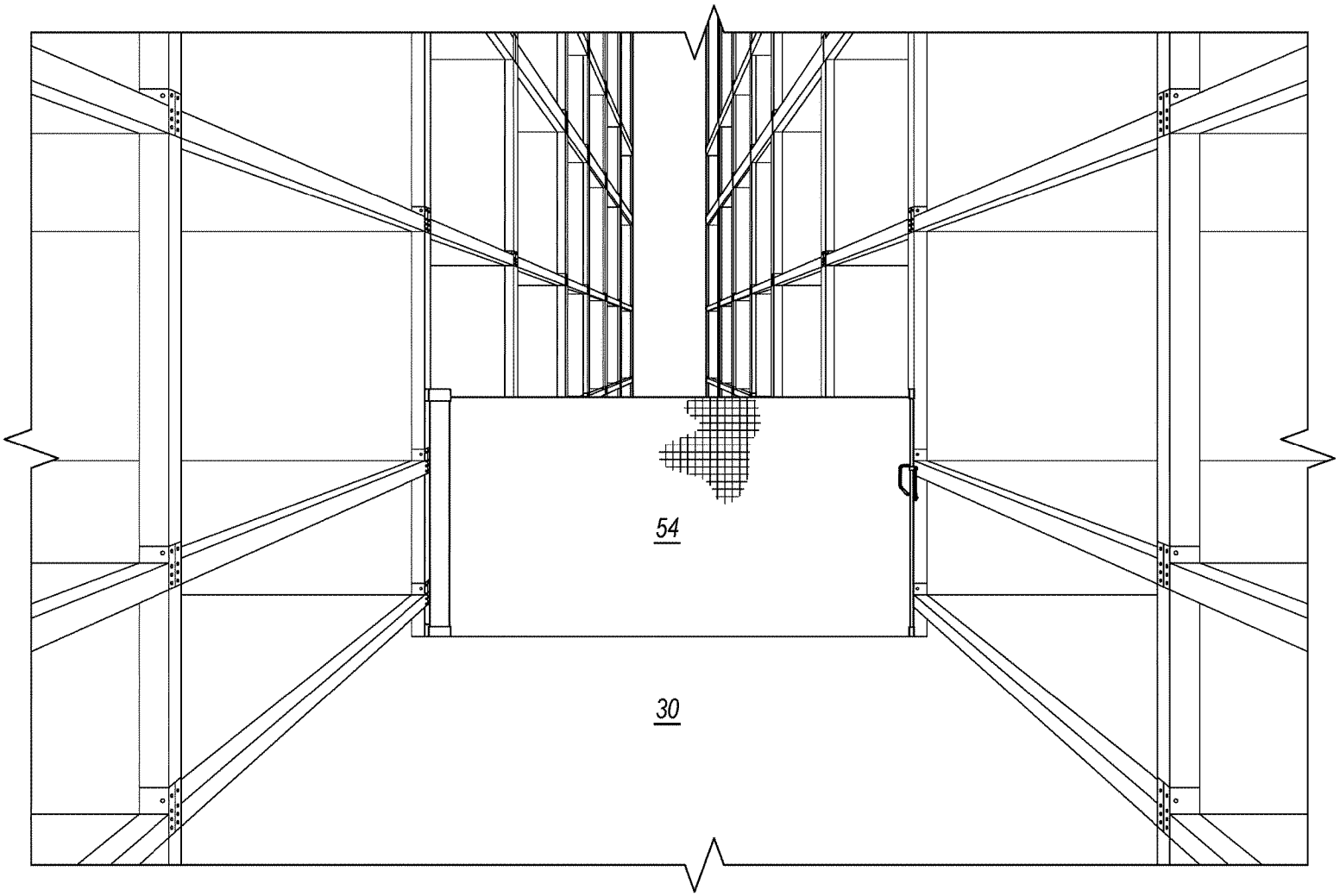
FIG. 20 is a side elevation view of the exemplary embodiment of the retractable barrier system of FIGS. 17-19 shown engaged with and extended between opposing receiving posts of an exemplary pallet rack assembly.

In the preferred embodiment shown in detail in FIGS. 17-19, gate attachment member 116 comprises a bar arm 118 affixed to pull member 72 by sleeve 120 at any suitable location, including within cutout section 112 or affixed to handle 114. Sleeve 120 (and bar arm 118 affixed thereto) may together function to vertically slide on pull bar 72 to provide adjustable attachment of flexible screen 54 to a receiving post 12 and more particularly, by attachment of bar arm attachment member 124 (itself affixed to bar arm 118) to a corresponding aperture 24 of an outward facing post section 16 or side post section 18. Sleeve 120 may also function to horizontally pivot about pull member 72 to similarly provide adjustable attachment thereof to a corresponding aperture 24 of an outward facing post section 16 or side post section 18. Bar arm 118 may also vertically pivot about pivot point 122 to provide adjustable attachment thereof to a corresponding aperture 24 of an outward facing post section 16 or side post section 18. Bar arm 118, and more particularly bar arm attachment member 124 may therefore be affixed at a multitude of orientations to a receiving member such as an aperture 24 of a receiving post member 12 to accommodate a variety of intervening objects as well as potentially occupied receiving apertures 24. In this preferred embodiment, handle cutout 112 is also disposed slightly above center of the vertical length of pull bar 72 for optimum leverage. In the preferred embodiment shown, bar arm 118 includes a suitable attachment mechanism or member such as hook bracket 124 having a width W that is less than a distance D hook bracket or brackets 66 extend from a vertical reference plane of leading edge 64 of flexible screen 54. Accordingly, bar arm 118 may be rotated downward (or upward) into a disengaged position when not required or desired for use without interfering with or precluding use of hook bracket or brackets 66 as shown, for example, in FIG. 28. It is understood that the foregoing components, along with hook brackets 66, are illustrated as preferred embodiments only and are not intended to and do not limit the scope of the claimed invention as a variety of suitable attachment mechanisms may be used in addition to or in place of the foregoing. The assembled flexible barrier system 50 of this preferred embodiment as installed in a conventional pallet rack system or assembly is shown in FIG. 20.

Figure 21:
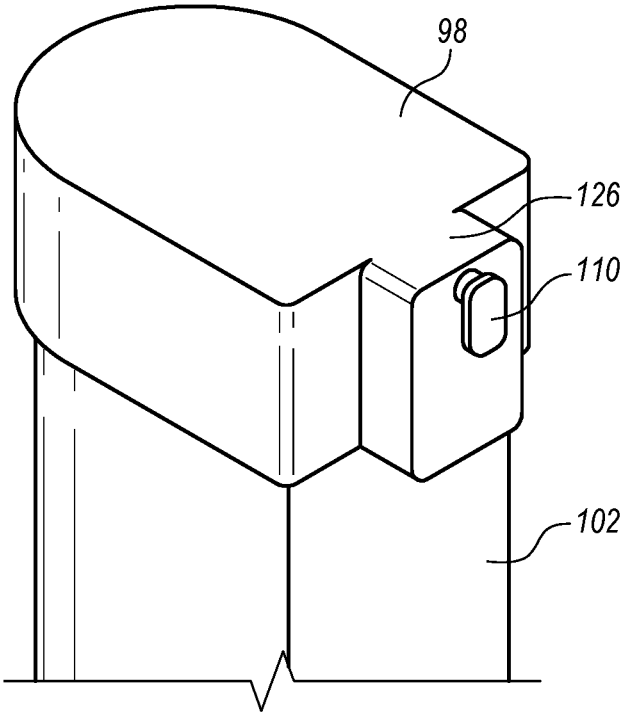
FIG. 21 is a partial perspective diagram of the exemplary embodiment of the preceding figures further illustrating a set-off portion that may be provided for bridging intervening objects including one or more rack beams or bolts as may be present in the referenced exemplary pallet rack system application.
Figure 22:
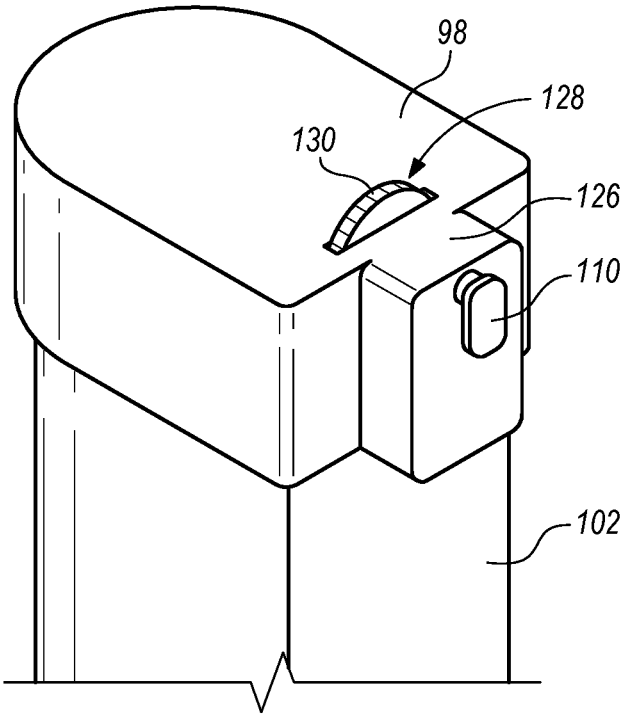
FIG. 22 is a partial perspective diagram of the exemplary embodiment of the preceding figures wherein the set-off portion of FIG. 18 further includes an adjustable attachment mechanism for laterally extending and retracting a corresponding hook member.

Turning now to FIG. 21, an exemplary, but not required, application of the flexible barrier system of the present invention is hereinafter described. As shown in FIG. 21, a least one "standoff" portion 126 is directly or indirectly affixed to and extendable from rotatable mounting rod 52 and more preferably, but not necessarily, housing 102 or top or bottom caps 98 or 100, respectively. Stand-off portion 126 further includes a first attachment mechanism such as a lug or hook bracket 110 that may be affixed thereto for coupling barrier system or assembly 50 at its trailing end to a corresponding first receiving member such as a keyhole slot 24 of a an outward facing post section 16 or side post section 18 of a pallet post 12. The foregoing standoff portion 126 and attachment mechanism 110 function independently and collectively to provide "bridging" over intervening objects such as rack beams 14 and/or fasteners 26 or displayed product or machinery or the like which may be positioned on or near racking system 10 and extend into aisle or entryway 30 within the span of the top and bottom ends (e.g. top and bottom ends of housing 102) of barrier system 50 generally and mounting rod 52, specifically. Standoff portion or portions 126 and attachment mechanism or mechanisms 110 further permit attachment to the aforementioned pallet rack assembly posts 12 (including outward facing post sections 16 and/or side post sections 18) in the event one or more keyhole slots 24*a* in a given vertical row are occupied leaving the corresponding horizontal pairs 24*b* available, and vice versa.

Figure 23:
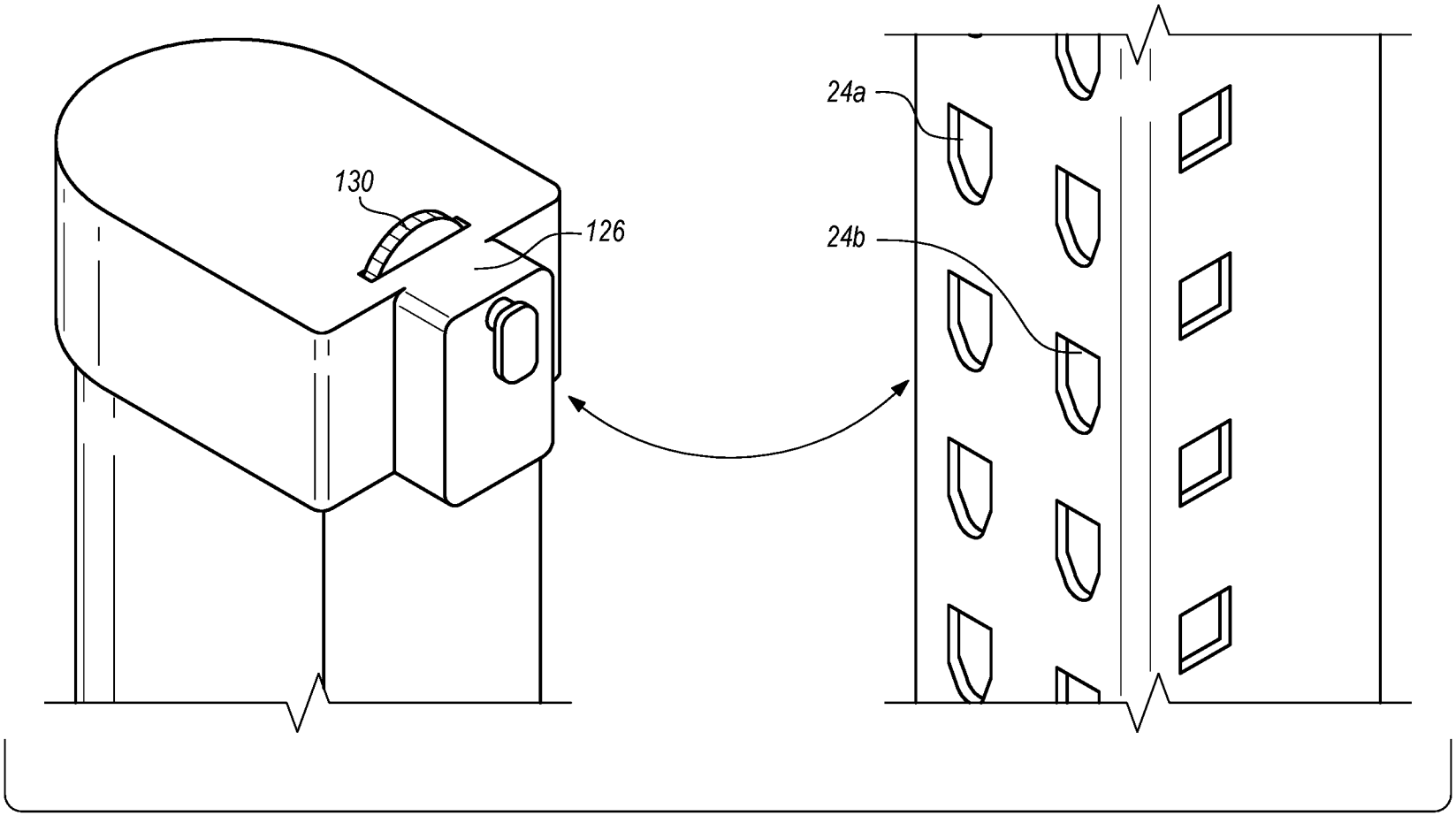
FIG. 23 is a partial perspective diagram of the exemplary embodiment of FIG. 22 illustrating in detail the adjustable attachment mechanism therein.
Figure 24:
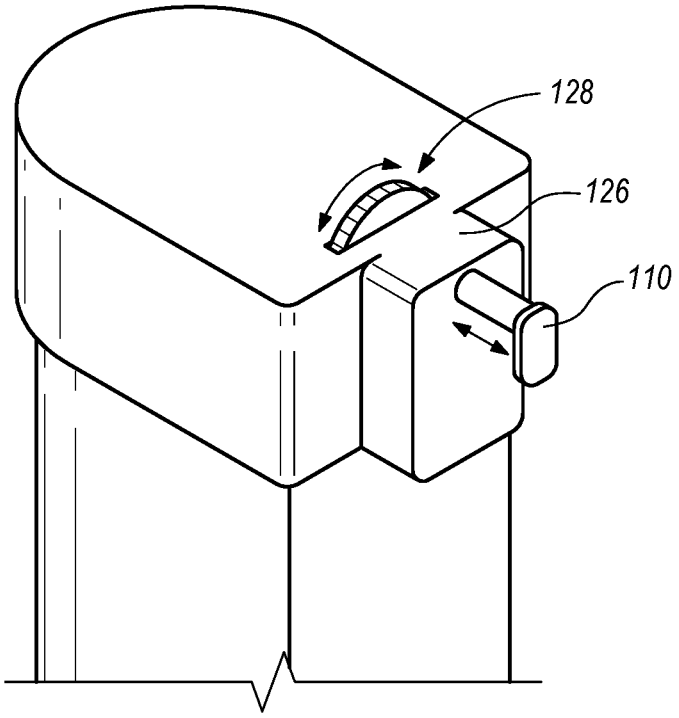
FIG. 24 is a partial perspective diagram of the exemplary embodiment of FIG. 22 illustrating in detail the adjustable attachment mechanism therein.
Figure 25:
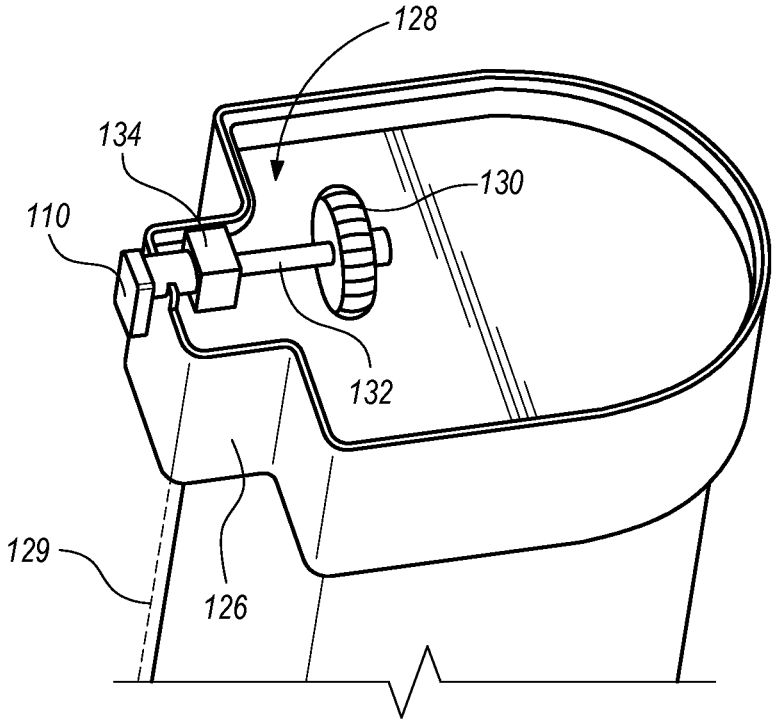
FIG. 25 is a partial perspective diagram of the exemplary embodiment of FIG. 22 illustrating in detail the adjustable attachment mechanism therein.
Figure 26:
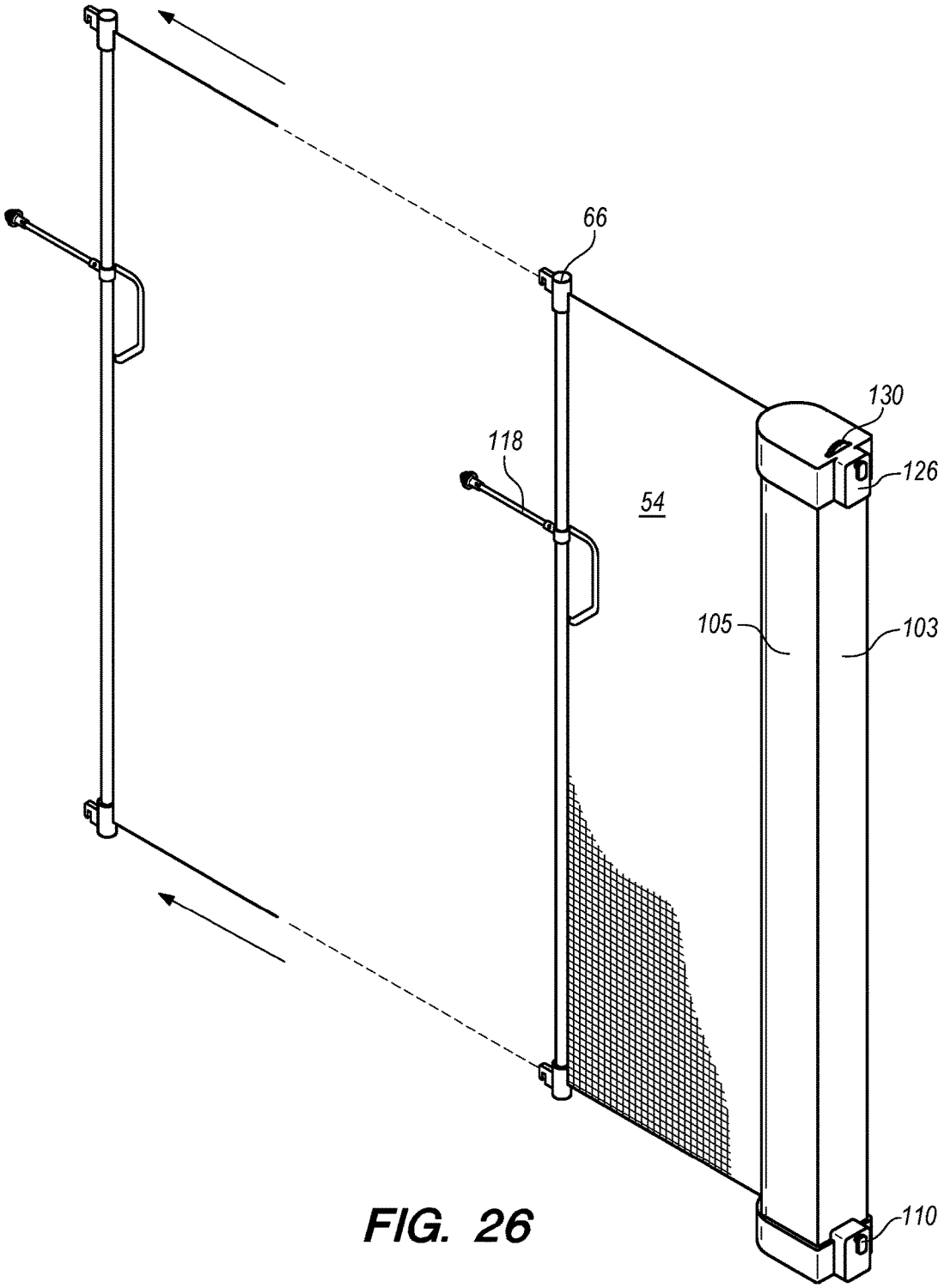
FIG. 26 is a perspective diagram of the exemplary embodiment of the retractable barrier system of FIGS. 22-25 shown disengaged from receiving posts and illustrating the extension path of the corresponding flexible screen.

In the exemplary application shown in FIGS. 22-25, the attachment mechanism 110 may include an adjustment mechanism 128 for adjusting a distance the mechanism (e.g. a hook bracket 110) extends therefrom substantially in a horizontal direction such as, for example, from a corresponding vertical plane 129 of the referenced standoff portion or portions 126. As shown, adjustment mechanism may comprise an adjustment wheel 130 affixed to screw pin or threaded shaft 132 that is similarly affixed to hook member 110. Wheel 130 is threaded through anchor 134 which biases and anchors hook member 110. Upon turning wheel 130, screw pin is received within or retracted out of anchor 134 and hook member horizontally extends or retracts accordingly from vertical plane 129. More specifically, shaft 132 is disposed within and extends through a cutout formed in top cap 98 that also functions, in conjunction with anchor 134, to provide anchoring to wheel 130. By rotating wheel 130 in a forward or reverse direction, threaded shaft 132 correspondingly moves hook member through the referenced cutout portion in a substantially horizontal direction to extend or retract hook barrier in relation to a vertical plane of standoff portion 126 thereby providing additional adjustment capability for "hooking" and coupling the respective cap and thus the housing 102 to the referenced receiving posts (namely outward facing post sections 16 and/or side post sections 18). Similar functionality may, of course, be provided at the leading gate end and incorporated with hook brackets 66 and/or pull bar 72. The assembled barrier system 50 of this preferred embodiment is shown in FIG. 23 and further includes the attachment mechanism of the previously discussed preferred embodiment.

Referring to FIGS. 27-29, the standoff portions 48 and attachment mechanisms 50 function to provide "bridging" at the trailing gate end 56 over intervening objects such as the above referenced rack beams 14 and fasteners 26, as well as displayed product and machinery. As referenced above, standoff portions 126 and hook brackets 110 (with or without adjustment means 128) further permit attachment to the aforementioned pallet rack assembly posts 12 (including outward facing post sections 16 and side post sections 18) in the event one or more keyhole slots 24*a* in a given vertical row are occupied leaving the corresponding horizontal pair 24*b* available. Although shown and described as single piece top and bottom caps 98 and 100, each respective may comprise multiple pieces. For example, each cap may be a two-piece cap affixed to one another by screws or other suitable fastening means.

With specific reference to the exemplary application of FIGS. 27-29, a corresponding method for inhibiting access to designated areas such as by way of example, but not limitation, retail and warehouse aisles and the like, is shown generally in FIG. 30. The method comprises providing 150 a standoff portion extending from a vertical plane of a mounting member, wherein the mounting member is affixed to a rotatable rod and a trailing edge of a flexible screen, respectively. The method further comprises coupling 152 the mounting member to a corresponding first receiving member whereby the standoff portion provides bridging over intervening objects. Lastly, the method comprises coupling 154 a leading edge of the flexible screen to a corresponding second receiving member whereby the screen will be extended and secured to inhibit access to a corresponding area.

While embodiments of the invention have been illustrated and described, it is not intended that these embodiments illustrate and describe all possible forms of the invention. Rather, the words used in the specification are words of description rather than limitation, and it is understood that various changes may be made and equivalent structures, features, and functions may be provided without departing from the spirit and scope of the invention.

What is claimed is:

1. A retractable barrier system for temporary installation by a user to inhibiting access, retail and warehouse aisles defined by opposing first and second posts of a corresponding shelving assembly positioned on a floor, each post having an outwardly facing section and including a plurality of vertically spaced apertures, the system comprising:

a rotatable rod having a standoff portion extending therefrom substantially perpendicular to an axis of rotation of the rotatable rod and having a stand off hook for selectively coupling and decoupling with a first aperture selected from the plurality of vertically spaced apertures of the outwardly facing section of the first post to create a gap between the rotatable rod and the first aperture spanning over an object stored in proximity to the rotatable rod to avoid contact of the rotatable rod with the object;

a flexible screen having a leading edge, a trailing edge, and a top edge extending between the leading and the trailing edge, the trailing edge coupled to the rotatable rod, and the leading edge having a second attachment mechanism for selectively coupling and decoupling with a second aperture selected from the plurality of vertically spaced apertures of the outwardly facing section of the second post; and a winding mechanism coupled to the rotatable rod for retractably receiving and extending the flexible screen;

wherein the flexible screen is comprised of material having a modulus of elasticity sufficient to provide the screen with sufficient stiffness to inhibit binding or bunching up of the screen upon the retractably receiving the screen on the rotatable rod, and wherein the first and second apertures are selected by the user upon each installation to (a) adjust a first height of the flexible screen as measured between the floor and the corresponding top edge of the trailing edge, (b) adjust a second height of the flexible screen as measured between the floor and the corresponding top edge of the leading edge, and (c) to avoid contact with one or more objects stored in proximity to the corresponding posts, the foregoing permitting the retractable barrier system to be temporarily installed in a variety of different positions in the retail and warehouse aisles and readily removed following the completion of each use.

2. The retractable barrier system of claim 1, wherein the winding mechanism further comprises a guide member having a surface of sufficient diameter oriented substantially perpendicular to the flexible screen to guide the flexible screen upon retractably receiving the screen.

3. The retractable barrier system of claim 2, wherein the guide member is substantially rigid.

4. The retractable barrier system of claim 2, wherein the guide member is comprised of plastic.

5. The retractable barrier system of claim 2, wherein the guide member is integrally formed with the winding mechanism.

6. The retractable barrier system of claim 1, wherein the leading edge of the flexible screen has a first height and the trailing edge of the flexible screen has a second height less than the first height, whereby the flexible screen is tapered between the first and second heights.

7. The retractable barrier system of claim 1, wherein the winding mechanism comprises a spring mechanism.

8. The retractable barrier system of claim 7, wherein the spring mechanism comprises a torsion spring.

9. A retractable barrier system for temporary installation by a user to inhibit access to retail and warehouse aisles defined by opposing first and second posts of a corresponding shelving assembly positioned on a floor, each post having an outwardly facing section and including a plurality of vertically spaced apertures, the system, comprising:

a rotatable rod having a first attachment mechanism for selectively coupling and decoupling with a first aperture selected from the plurality of vertically spaced apertures of the outwardly facing section of the first post;

a flexible screen having a leading edge, a trailing edge, and a top edge extending between the leading and the trailing edge, the trailing edge coupled to the rotatable rod;

a bar arm having a first end affixed to the leading edge of the flexible screen and a second end having a bar arm hook for selectively coupling and decoupling with a second aperture selected from the plurality of vertically spaced apertures of the outwardly facing section of the second post, wherein the bar arm is rotatable at its first end in (a) a vertical plane about the leading edge of the flexible screen, and (b) a horizontal plane about the leading edge of the flexible screen, to orient the bar arm at selected angles within the respective vertical and horizontal planes to create a gap between the leading edge and the second aperture spanning over an object stored in proximity to the leading edge to avoid contact of the leading edge with the object; and a winding mechanism coupled to the rotatable rod for retractably receiving and extending the flexible screen, wherein the flexible screen is comprised of a material having a modulus of elasticity sufficient to provide the screen with sufficient stiffness to inhibit binding or bunching up of the screen upon the retractably receiving of the screen on the rotatable rod, and wherein the first and second apertures are selected by the user upon each installation to (a) adjust a first height of the flexible screen as measured between the floor and the corresponding top edge of the trailing edge, (b) adjust a second height of the flexible screen as measured between the floor and the corresponding top edge of the leading edge, and (c) to avoid contact with objects stored in proximity to the corresponding posts, the foregoing permitting the retractable barrier system to be temporarily installed in a variety of different positions in the retail and warehouse aisles and readily removed following the completion of each use.

10. A retractable barrier system for temporary installation by a user to inhibit retail and warehouse aisles defined by opposing first and second posts of a corresponding shelving assembly positioned on a floor, each post having an outwardly facing section and including a plurality of vertically spaced apertures, the system comprising:

a housing having a first end and a second end, a mounting side wall, and at least a supplemental sidewall having an elongate opening, the mounting sidewall and supplemental sidewall extending between the first and second housing ends;

a rotatable rod disposed within the housing and coupled thereto;

a shaft disposed within the rotatable rod;

at least one end cap affixed to the housing and having a standoff portion extending therefrom substantially perpendicular to an axis of rotation of the rotatable rod and having a stand off hook for selectively coupling and decoupling with a first aperture selected from the plurality of vertically spaced apertures of the outwardly facing section of the first post to create a gap between the housing and the first aperture spanning over an object stored in proximity to the housing to avoid contact of the housing with the object;

a flexible screen having a leading edge a trailing edge, and a top edge extending between the leading edge and trailing edge, the trailing edge coupled to the rotatable rod, and the leading edge having an edge attachment mechanism for selectively coupling and decoupling with a second aperture selected from the plurality of vertically spaced apertures of the outwardly facing section of the second post;

a winding mechanism coupled to the rotatable rod and rotatable about the shaft for retractably receiving and extending the flexible screen through the elongate opening of the supplemental sidewall;

a spring mechanism coupled to the winding mechanism and the shaft, the spring mechanism operative to apply rotational tension on the rotatable rod for retractably receiving the flexible screen; and a guide member coupled to the winding mechanism and having a surface of sufficient diameter oriented substantially perpendicular to the flexible screen to guide the flexible screen during the retractable receiving, wherein the first and second apertures are selected by the user upon each installation to (a) adjust a first height of the flexible screen as measured between the floor and the corresponding top edge of the trailing edge, (b) adjust a second height of the flexible screen as measured between the floor and the corresponding top edge of the leading edge, and (c) to avoid contact with objects stored in proximity to the corresponding posts, the foregoing permitting the retractable barrier system to be temporarily installed in a variety of different positions in the retail and warehouse aisles and readily removed following the completion of each use.

11. The retractable barrier system of claim 10, wherein the leading edge of the flexible screen has a first height and the trailing edge of the flexible screen has a second height less than the first height, whereby the flexible screen is tapered between the first and second heights.

12. The retractable barrier system of claim 10, wherein the guide member is integrally formed with the winding mechanism.

13. The retractable barrier system of claim 10, wherein the guide member comprises a plastic disk.

14. The retractable barrier system of claim 10, further comprising a spacer disposed between the guide member and a top surface of the at least one end cap to promote the smooth retractably receiving and extending of the flexible screen.

15. The retractable barrier system of claim 14, wherein the spacer comprises a plastic disk.

16. The retractable barrier system claim 14, wherein the spacer comprises a raised portion integrally formed on a bottom surface of the guide member.

17. The retractable barrier system of claim 16, wherein the raised portion comprises a plurality of nubs.

18. The retractable barrier system of claim 14, wherein the spacer comprises a raised portion integrally formed on a top surface of the at least one cap.

19. The retractable barrier system of claim 18, wherein the raised portion comprises a plurality of nubs.

20. A retractable barrier system for temporary installation by a user to inhibit access to retail and warehouse aisles defined by opposing first and second posts of a corresponding shelving assembly positioned on a floor, each post having an outwardly facing section and including a plurality of vertically spaced apertures, the system comprising:

a rotatable rod having a standoff portion extending therefrom substantially perpendicular to an axis of rotation of the rotatable rod and having a stand off hook for selectively coupling and decoupling with a first aperture selected from the plurality of vertically spaced apertures of the outwardly facing section of the first post to create a gap between the rotatable rod and the first aperture spanning over an object stored in proximity to the rotatable rod to avoid contact of the rotatable rod with the object;

a flexible screen having a leading edge, a trailing edge, and a top edge extending between the leading edge and the trailing edge, the trailing edge coupled to the rotatable rod, and the leading edge having a second attachment mechanism for selectively coupling and decoupling with a second aperture selected from the plurality of vertically spaced apertures of the outwardly facing section of the second post;

a winding mechanism coupled to the rotatable rod for retractably receiving and extending the flexible screen, and at least one support member coupled to the flexible screen to increase stiffness of the screen to promote the substantially smooth retractably receiving thereof, wherein the first and second apertures are selected by the user upon each installation to (a) adjust a first height of the flexible screen as measured between the floor and the corresponding top edge of the trailing edge, (b) adjust a second height of the flexible screen as measured between the floor and the corresponding top edge of the leading edge, and (c) to avoid contact with one or more objects stored in proximity to the corresponding posts, the foregoing permitting the retractable barrier system to be temporarily installed in a variety of different positions in the retail and warehouse aisles and readily removed following the completion of each use.

21. The retractable barrier system of claim 20, wherein the at least one support member comprises a plastic strip.

* * * * *